US007332868B2

(12) United States Patent
Okamoto et al.

(10) Patent No.: US 7,332,868 B2
(45) Date of Patent: Feb. 19, 2008

(54) DISCHARGE LAMP LIGHTING DEVICE

(75) Inventors: Masashi Okamoto, Hyogo (JP); Takanori Samejima, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 170 days.

(21) Appl. No.: 11/349,224

(22) Filed: Feb. 8, 2006

(65) Prior Publication Data

US 2006/0175984 A1 Aug. 10, 2006

(30) Foreign Application Priority Data

Feb. 9, 2005 (JP) ..... 2005-032467

(51) Int. Cl.
*H05B 31/00* (2006.01)

(52) U.S. Cl. ..... 315/209 R; 315/291; 315/247; 315/219; 315/224; 315/307; 315/308; 315/274; 315/289

(58) Field of Classification Search ..... 315/209 R, 315/291, 219, 224, 274, 307, 308, 247, 289, 315/205, 158

See application file for complete search history.

(56) References Cited

U.S. PATENT DOCUMENTS 6,605,906 B2 * 8/2003 Okamoto et al. ..... 315/291
6,914,393 B2 * 7/2005 Nakagawa et al. ..... 315/246

FOREIGN PATENT DOCUMENTS

JP 10-003996 A 1/1998
JP 11-283781 A 10/1999
JP 11-339993 A 12/1999

* cited by examiner

*Primary Examiner*—Douglas W. Owens
*Assistant Examiner*—Chuc Tran
(74) *Attorney, Agent, or Firm*—Rader, Fishman & Grauer, PLLC

(57) ABSTRACT

The present discharge lamp lighting device is capable of rapid modulation in which a lamp current is rapidly reduced and rapidly restored. The current control circuit is provided to perform specific current control such that the brightness of a lamp is reduced by a predetermined percentage without being affected by a variation or change in lamp voltage over time, thereby reducing a lamp current.

7 Claims, 10 Drawing Sheets

DISCHARGE LAMP LIGHTING DEVICE

RELATED APPLICATION

The disclosure of Japanese Patent Application No. 2005-032467, filed Feb. 9, 2005, including the specification, claims and drawings thereof, is incorporated herein by reference in its entirety.

TECHNICAL FIELD OF THE INVENTION

The present invention relates to a discharge lamp lighting device for lighting a discharge lamp, particularly, a high intensity discharge lamp, such as a high-pressure mercury lamp, a metal halide lamp, and a xenon lamp.

DESCRIPTION OF RELATED ART

For example, a high intensity discharge lamp (an HID lamp) is used for a light source device of an image displaying optical apparatus, such as a liquid crystal projector or a DLP™ projector. In order to light this type of lamp, a voltage, called a no-load open discharge voltage, is applied to the lamp, and then a high voltage is overlapped with the voltage to generate a dielectric breakdown in a discharge space. Then, a glow discharge and an arc discharge sequentially occur.

In general, the HID lamp is lighted with a uniform voltage, that is, uniform brightness. However, in certain instances, the brightness of the HID lamp needs to be reduced rapidly, or a current flowing through the HID lamp needs to be broken for a short time.

For example, as an example of the breaking and reduction modulations, when the HID lamp is applied to a light source device for image display of the DLP projector, a rotary filter having regions for three primary colors, red, green, and blue is used. In a period during which light emitted from a light source is incident on boundaries between the color regions of the filter, light emitted from the filter does not have a pure color. Therefore, when color reproducibility is concerned very highly, light emitted from the filter in this period is not used for image display by a spatial modulation element. That is, when power is not supplied to the lamp within the periods and power is supplied to the lamp at periods other than the periods of no power supply, a waste of power consumption is reduced, which is preferable from the viewpoint of power savings. In addition, in this case, since a small amount of heat is generated, cooling capability required for the lamp, the power supply circuit, and the spatial modulation element is reduced, which is preferable in reducing the size, weight, noise, and manufacturing costs of a device.

However, a lamp current should be rapidly broken or interrupted in a current breaking period, and the lamp current should return to its original state in which the current was immediately before the interruption, when the current breaking period is passed. If the lamp current is slowly broken, it slowly returns to its original state, or overshoot or oscillation occurs in the waveforms of the lamp current at the time of return, the image quality of a projector is deteriorated. In order to prevent the deterioration of image quality, the lamp current needs to return to its original state earlier than a required return timing for removing oscillation, which makes it difficult to reduce power consumption.

Further, in this case, when the lamp current is completely interrupted, the temperature of electrodes or plasma in the lamp discharge space is rapidly lowered in this period. Therefore, even if the power supply circuit has capability of rapidly breaking the lamp current or of returning it to the original state, a long breaking time causes a problem in that the discharge lamp cannot resume discharge, or an abnormal emission spectrum occurs immediately after the discharge. Under these conditions, it is advantageous to greatly reduce a lamp current, but not to completely break the lamp current.

However, when the lamp current is reduced, it is necessary to quantitatively reduce the lamp current. For example, it is necessary to reduce the lamp current to 25% of lamp current at the time of a normal lighting mode. In this case, when the reduced lamp current is non-uniform due to a variation in the lamp current or a variation in characteristics depending on the life span of the lamp, the lamp current after returning from the reduced state to its original state is also non-uniform. Then, the timing of resuming the spatial modulation of the projector apparatus is delayed, which causes a problem in that the waveform of the lamp current oscillates at the time of return.

The discharge lamp lighting device for an HID lamp is configured so as to compare power supplied to a lamp with a predetermined power target value and to perform feedback control so as to be equal to each other, thereby obtaining desired power. In order to change the brightness of a light source, the discharge lamp lighting device changes the power target value.

More specifically, for example, there is a method of detecting a lamp voltage and a lamp current, in order to calculate a lamp power value by multiplying the current and the voltage, thereby comparing it with the power target value. In this case, the multiplication may be performed on an analog lamp voltage signal and an analog lamp current signal by using an analog multiplying circuit. Alternatively, a digital lamp voltage signal and a digital lamp current signal may obtained by a microprocessor having an AD converter integrated thereinto which is mounted on a discharge lamp lighting device, and the multiplication may be formed by using the microprocessor.

For example, Japanese Laid Open Patent No. 11-283781 discloses a method of detecting a lamp voltage and a lamp current, in order to calculate a current target value by dividing a power target value by the lamp voltage, thereby comparing the current target value with the lamp current. In this case, in order to calculate the current target value, a digital lamp voltage signal is obtained by using a microprocessor having an AD converter integrated thereinto, and multiplication is performed by using the microprocessor.

Further, for example, Japanese Laid Open Patent No. 11-339993 discloses a method of increasing the resistance value of a resistor for detecting a lamp current at the time of lighting control, by detecting the lamp current and a lamp voltage, inputting them into a multiplier, and comparing an output value of the multiplier with a reference value.

Furthermore, for example, Japanese Laid Open Patent No. 10-3996 discloses a device which includes a lamp voltage detecting unit for detecting a lamp voltage, a lamp current detecting unit for detecting a lamp current, and a variable voltage divider which performs a dividing operation on outputs of the two units to change a division ratio at the time of lighting control and which controls main circuits for lighting, on the basis of the output of the variable dividing unit.

The reason why the power target value is varied in order to change the brightness of a lamp is that an HID lamp has a specific voltage characteristic. That is, the voltage of the lamp is a relatively low value of 10 V immediately before an arc discharge is generated. However, thereafter, the lamp voltage rises with an increase in the temperature of the lamp, and the lamp turns to a normal lighting state. The voltage in the normal lighting state is almost stable for a short period, but changes due to, for example, the life span of electrodes in the long run. For example, the voltage of a lamp is about 60 V at the beginning of use, but it rises up to about 140 V at the end of the life span thereof. When the lamp has a rated voltage of about 200 W, the lamp has a lamp current of about 3.3 A at the beginning of use, but has a lamp current of about 1.4 A at the end of the life span thereof.

The brightness of a light source is proportional to power supplied to a lamp. Therefore, when the brightness of the lamp is changed, the power needs to be controlled such that it is reduced to about 80% of reference voltage, for example, rated power. However, as described above, the lamp current is changed in the HID lamp. Therefore, when the lamp power is modulated to change the brightness of the lamp, it is difficult to specify power only by specifying the lamp current. Thus, it is necessary to change the power target value.

However, the conventional techniques have the following problems. As a first problem, it is difficult to rapidly modulate the brightness of a light source. As compared with the technique of comparing power supplied to a lamp with a predetermined power target value in order to perform feedback control such that they are equal to each other, the method of changing the power target value needs multiplication or division. For example, in order for a high-speed modulation, the method needs to have a high-speed AD converter, a microprocessor, or a high-speed analog divider or multiplier, which results in an increase in manufacturing costs.

Further, in particular, when the microprocessor is used for AD conversion, multiplication, or division, signals are sampled every certain period and signal processing for modulation is performed. In this method, since the signal processing is performed every sampling period, it is difficult for an illumination request generating circuit to control modulation timing. In a method in which a timing signal is provided to give processing timing, since the time until the microprocessor responds to the timing signal by interruption depends on the processes that has been performed inside the processor until that time, the modulation timing cannot be accurately defined. Therefore, jitter (variation in the direction of the time axis) occurs in a modulation profile.

In order to solve the problem of the above structure in which the power target value is changed and modulated, a method of directly operating a PWM modulation circuit, such as a down chopper, of a converter without changing the power target value is considered. According to this method, it is unnecessary to change the power target value with time, resulting in a high-speed operation. In addition, it is possible to solve the problem of jitter by directly driving, for example, a transistor on the basis of signals output from a circuit requiring modulation and by changing a duty cycle ratio of PWM modulation. However, this method has problems in that it cannot appropriately cope with a variation of the lamp voltage or a variation thereof with time, and be applied to deep modulation including the breaking of the lamp current, which is required for the above-mentioned breaking and reduction modulation.

The reason is as follows. In general, a power supply circuit for supplying power to a discharge lamp is provided with a smoothing capacitor for stabilizing an output voltage to reduce ripples. However, in case of deep modulation, a lamp voltage is excessively greatly changed due to modulation. Therefore, even if the power supply circuit has a high-speed modulation capability, the lamp needs to use, by power consume, some of charges stored in the smoothing capacitor, which correspond to a variation of the lamp voltage, in order to reduce the lamp current. On the other hand, in order to return the lamp current to its original level, the power supply circuit needs to increase the lamp current and to charge the smoothing capacitor. The two cases take time depending on the capacitance of the smoothing capacitor.

SUMMARY OF THE INVENTION

The present discharge lamp lighting device is capable of rapid modulation in which a lamp current of the lamp current rapidly is interrupted or reduced and restored rapidly.

A discharge lamp lighting device that lights a discharge lamp having a pair of main discharge electrodes facing each other, comprises a power supply circuit which supplies power to the discharge lamp, a current control element circuit which reduces a current flowing through the discharge lamp, a current reduction modulation control circuit to which an output current modulation instruction signal is input, wherein the power supply circuit includes an output current detecting unit which detects an output current of the power supply circuit to generate an output current detecting signal, and wherein when the output current modulation instruction signal Sq is in an inactive state, the current reduction modulation control circuit controls the current control element circuit not to substantially restrict the current, and when the output current modulation instruction signal is in an active state, the current reduction modulation control circuit controls the current control element circuit such that the output current detecting signal is substantially equal to a value obtained by multiplying, by a proportional constant, the output current detecting signal obtained when the output current modulation instruction signal is activated.

As described above, the discharge lamp lighting device according to the present invention is capable of rapid modulation in which a lamp current of the lamp current rapidly is interrupted or reduced and restored rapidly.

BRIEF DESCRIPTION OF THE DRAWINGS

These and other features and advantages of the present discharge lamp lighting device will be apparent from the following description taken in conjunction with the accompanying drawings.

DETAIL DESCRIPTION OF THE INVENTION

Figure 1:
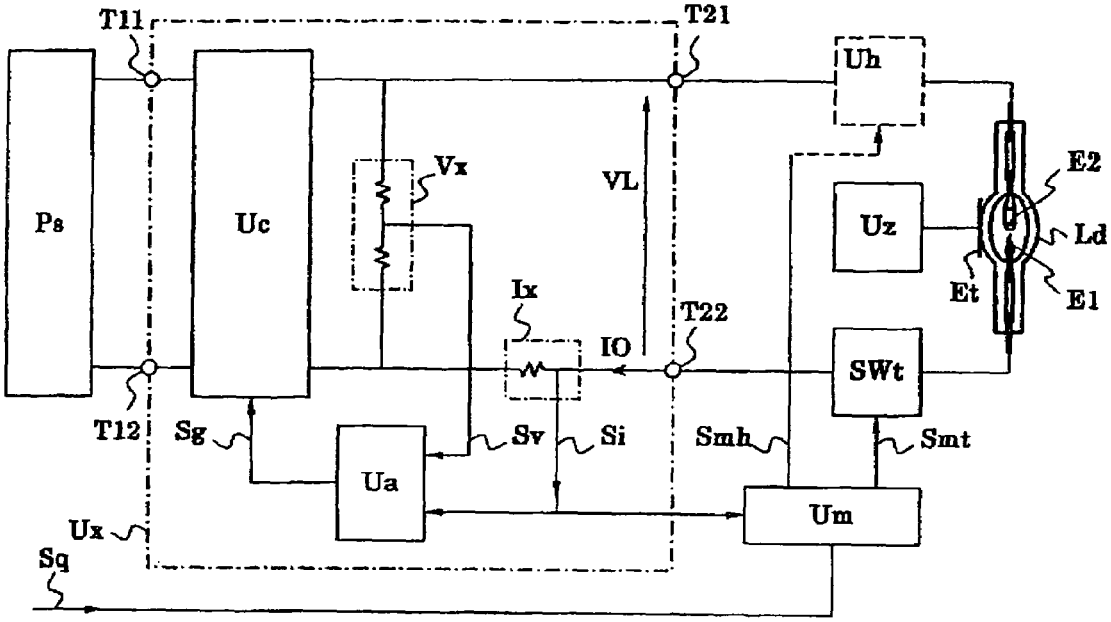
FIG. 1 is a block diagram schematically illustrating a discharge lamp lighting device according to an embodiment of the present invention.

FIG. 1 is a block diagram schematically illustrating an embodiment of a discharge lamp lighting device according to the invention. An embodiment according to the invention will be described with reference to FIG. 1. The discharge lamp Ld is connected to a start circuit Uz for starting the discharge thereof. FIG. 1 shows an external trigger method in which a high voltage is applied to a trigger electrode Et provided at the outside of the discharge lamp Ld. However, the trigger method does not concern the essence according to the invention. A power supply circuit Ux is connected so as to supply power to the discharge lamp Ld through main discharge electrodes E1 and E2 of the discharge lamp Ld. The power supply circuit Ux has a function for converting the power supplied from a DC power source Ps into power suitable for the discharge lamp Ld by using a converter Uc of, for example, a down-chopper type or an up-chopper type.

An output current detecting unit Ix detects an output current IO of the power supply circuit Ux, that is, a lamp current, to generate an output current detecting signal Si and outputs the generated signal to a power supply control circuit Ua. Further, when the output current detecting signal Si is a weak signal, for example, an amplifier may be provided, if necessary. However, since the amplifier does not concern the essence of the invention, it is not provided. In general, an output voltage detecting unit Vx detects an output voltage VL of the power supply circuit Ux, that is, a lamp voltage, to generate an output voltage detecting signal Sv and outputs the generated signal to the power supply control circuit Ua. Then, the power supply control circuit Ua determines a lamp current target value for realizing target power according to the level of the output voltage detecting signal Sv, and perform feedback control to adjust the capability of the converter Uc in order to realize the target value, on the basis of a gate driving signal Sg.

A current control element circuit SWt composed of, for example, an FET is connected in series to the discharge lamp Ld. An output current modulation instruction signal Sq is input to a current reduction modulation control circuit Um. When the output current modulation instruction signal Sq is in an inactive state, the current reduction modulation control circuit Um controls the current control element circuit SWt to turn to a saturated connection state in which the current control element circuit SWt does not substantially restrict the flow of a current, on the basis of a current restriction control signal Smt. The discharge lamp lighting device lights the discharge lamp Ld in a normal mode in this state. On the other hand, when the output current modulation instruction signal Sq is in an active state, the current reduction modulation control circuit Um controls the current control element circuit SWt such that the value of the output current detecting signal Si when the output current modulation instruction signal Sq is activated is held and the output current detecting signal Si is substantially equal to a value obtained by multiplying the held value by a proportional constant K smaller than 1. As a result, the output current IO of the power supply circuit Ux is immediately reduced (broken). When the output current modulation instruction signal Sq returns to the inactive state, the current reduction modulation control circuit Um immediately returns to the state in which it controls the current control element circuit SWt not to substantially restrict a current.

As described above, in the discharge lamp lighting device according to the invention shown in FIG. 1, when the lamp current is reduced, the current control element circuit SWt connected in series to the discharge lamp Ld reduces a current or releases the current reducing operation by controlling the output current modulation instruction signal Sq to be active or inactive, without waiting for the response of a delay circuit, such as a microprocessor or a complicated power control feedback loop. Therefore, it is possible to rapidly reduce a current and to rapidly release the reduction of the current. Further, since the discharge lamp lighting device is operated without waiting for the response of a circuit having internal timing, such as a microprocessor or a converter, delay in operation is reduced to the minimum, so that no jitter occurs.

When the output current modulation instruction signal Sq is in the active state for a short time, the above-mentioned discharge lamp lighting device is normally operated. However, when the output current modulation instruction signal Sq is in the active state for a relatively long time, it is preferable to use a new structure. The reason will be described below. In a period during which the output current modulation instruction signal Sq is in an active state, when the power supply control circuit Ua continues the operation in a feedback control manner in order to adjust the capability of the converter Uc, on the basis of the gate driving signal Sg, by determining the lamp current target value in order to realize the target power according to the level of the output voltage detecting signal Sv, the output voltage VL of the power supply circuit Ux rises due to a combination of the operations of the power supply control circuit Ua and the lamp current reducing operation of the current reduction modulation control circuit Um. When the output current modulation instruction signal Sq returns to the inactive state, overshoot may occur in the output current IO.

However, in order to stabilize the system, the power supply control circuit Ua delays, as much as possible, the operation in a feedback control manner in order to adjust the capability of the converter Uc, on the basis of the gate driving signal Sg by determining the lamp current target value in order to realize the target power according to the level of the output voltage detecting signal Sv. Therefore, as described above, in general, a short active period of the output current modulation instruction signal Sq does not matter.

When a period during which the output current modulation instruction signal Sq is in an active state is relatively long, the most simple and effective method is to stop operating the converter Uc so that the output voltage VL of the power supply circuit Ux does not rise, in the period where the output current modulation instruction signal Sq is in the active state. In general, a smoothing capacitor for stabilizing an output voltage is provided at an output end of the converter Uc. When the capacitance of the smoothing capacitor is set to be sufficiently large, it is possible to supply, from the smoothing capacitor, the lamp current reduced in the period during which the output current modulation instruction signal Sq is in the active state. However, in the method, when the output current modulation instruction signal Sq returns to the inactive state, the output voltage VL of the power supply circuit Ux depends on the period during which the output current modulation instruction signal Sq is in an active state and the magnitude of the output current IO in that period. The output current modulation instruction signal Sq is slightly smaller than the output current obtained immediately before the output current modulation instruction signal Sq was activated. Therefore, time is required for restoring the reduced output current IO.

In order to solve the problems in that the overshoot of the output current IO occurs and a long restoration time is required for restoring the reduced output current without depending on the period during which the output current modulation instruction signal Sq is in the active state and the magnitude of the output current IO in that period when the output current modulation instruction signal Sq is in the inactive state, it is effective to make the output voltage VL of the power supply circuit Ux uniform in the period during which the output current modulation instruction signal Sq is in the active state. This can be achieved by the structure set forth below. When the output current modulation instruction signal Sq is in the inactive state, the power supply control circuit Ua determines a lamp current target value for realizing the target power according to the magnitude of the output voltage detecting signal Sv, and the power supply control circuit Ua generates the gate driving signal Sg and controls the converter Uc such that a difference between the output current detecting signal Si and an output current target signal St indicating a control target value with respect to the output current detecting signal Si is reduced. On the other hand, when the output current modulation instruction signal Sq is in the active state, the power supply control circuit Ua generates the gate driving signal Sg and controls the converter Uc such that a difference between the output voltage detecting signal Sv when the output current modulation instruction signal Sq is activated and the output voltage detecting signal Sv is reduced.

The following structure can be used as a specific circuit for performing control such that the difference between the output voltage detecting signal Sv when the output current modulation instruction signal Sq is activated and the output voltage detecting signal Sv, is reduced. For example, in a broad sense, when the output current modulation instruction signal Sq is activated, the output voltage detecting signal Sv is held, and then, a control target signal and a control object signal are switched such that, when the output current modulation instruction signal Sq is in the inactive state, the output current target signal St is the control target signal and the output current detecting signal Si is the control object signal; however, when the output current modulation instruction signal Sq is in the active state, the held output voltage detecting signal Sv is the control target signal and the output voltage detecting signal Sv is the control object signal.

In this way, when the output current modulation instruction signal Sq is in the active state, it is possible to maintain the value of the output voltage detecting signal Sv when the output current modulation instruction signal Sq is activated, by the feedback control function of the power supply control circuit Ua with respect to the capability adjustment of the converter Uc. Therefore, in the discharge lamp lighting device having the above-mentioned structure according to the present invention, it is possible to rapidly reduce the lamp current or to rapidly restore the reduction of the lamp current by controlling the output current modulation instruction signal Sq to be active or inactive. Thus, it is possible to solve the problem of the overshoot of the output current IO and the problem of a long restoration time being required for restoring the reduction of the output current IO when the output current modulation instruction signal Sq returns to the inactive state, without depending on the period where the output current modulation instruction signal Sq is in the active state and the magnitude of the output current IO in that period.

When a lamp current breaking operation is performed over a predetermined breaking time of lamp current which depends on the specifications of a discharge lamp, the lamp may not be turned on after releasing the breaking operation. In addition, in the reduction of the lamp current, when a lamp current reducing operation is performed over a reduction ratio or over a predetermined duration of the reduced state which depends on the reduction ratio, discharge fades away, causing the discharge lamp to be turned off. For example, in a case of a high-pressure mercury lamp having specification in which a distance between electrodes is smaller than 2 mm, the amount of sealed mercury is more than 0.15 mg/mm$^3$, and the amount of sealed halogen is more than $1\times10^{-6}$ to $1\times10^{-2}$ micromol/mm$^3$, the maximum breaking time is 4 ms.

When the lamp current needs to be reduced or broken under the conditions in which the above-mentioned phenomenon may occur, it is necessary to provide a temporary booster unit Uh for temporarily raising a voltage to be applied to the discharge lamp Ld in order to avoid the above-mentioned phenomenon, as represented by broken lines in FIG. 1. When the output current modulation instruction signal Sq returns to the inactive state, the current reduction modulation control circuit Um controls the current control element circuit SWt to release the current reducing operation and activates a temporary booster unit trigger signal Smh for operating the temporary booster unit Uh. Then, in addition to the output voltage VL of the power supply circuit Ux, a voltage raised by the temporary booster unit Uh is applied to the discharge lamp Ld by the operation of releasing the current reducing operation.

Although the conditions of the voltage to be applied in this case depend on the specification of the lamp, the reduction ratio of the current control element circuit SWt or time, it is effective to use a pulse voltage with a half width of about 100 ns which has a peak voltage as high as the no-load open circuit voltage. For example, in general, the high-pressure mercury lamp having the above-mentioned specification has a normal lamp voltage of about 100 V and a no-load open circuit voltage of about 300 V. Therefore, if the temporary booster unit Uh is not provided, a voltage of about 100 V is applied to the lamp when the current control element circuit SWt releases the current reducing operation. However, when the temporary booster unit Uh is provided, a voltage of about 300 V is applied thereto, which is preferable to improve the effects according to the invention.

Since the current control element circuit SWt is a variable resistor, power is consumed and heat is generated for a period of time for which a current flows through the variable resistor. In case that the output current modulation instruction signal Sq is a pulse having a short time width and the current control element circuit SWt has a heat dissipation mechanism, when the active state of the output current modulation instruction signal Sq lasts for an excessively long time or when the output current modulation instruction signal Sq very frequently turns to the active state due to a certain factor, the current control element circuit SWt may be damaged due to a sharp rise in the internal temperature thereof. This is apt to occur, for example, when the output current modulation instruction signal Sq is supplied from the outside of the discharge lamp lighting device.

Figure 2:
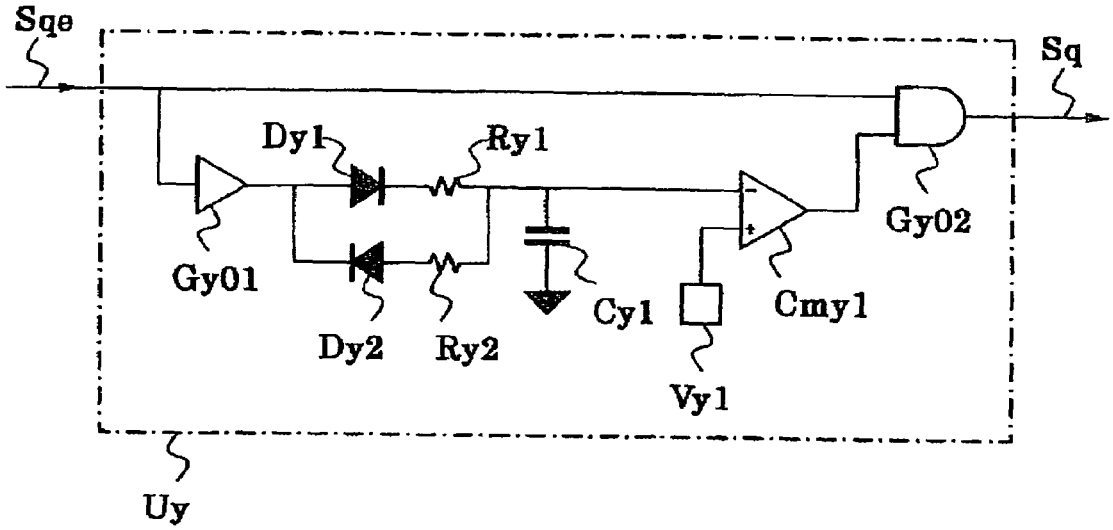
FIG. 2 is a diagram schematically illustrating a portion of the discharge lamp lighting device according to the embodiment of the invention.

FIG. 2 shows the structure of an output current modulation instruction signal correcting circuit Uy for protecting the current control element circuit SWt from this problem. When an original output current modulation instruction signal Sqe with a positive logical value, which is supplied from the outside, is activated, charges are stored in a capacitor Cy1 through a buffer Gy01, a diode Dy1, and a charging resistor Ry1. As the active state of the original output current modulation instruction signal Sqe lasts for a longer time, or as the original output current modulation instruction signal Sqe more frequently turns to the active state, a higher voltage is formed at both ends of the capacitor Cy1. On the other hand, when the original output current modulation instruction signal Sqe is in an inactive state, the capacitor Cy1 is discharged through a diode Dy2 and a discharging resistor Ry2. As the inactive state of the original output current modulation instruction signal Sqe lasts for a longer time, or as the original output current modulation instruction signal Sqe more frequently turns to the inactive state, the capacitor Cy1 is more rapidly discharged, so that a voltage gradually approaches zero volt.

This circuit is considered as a simulation model in which the voltage of the capacitor Cy1 corresponds to an internal temperature value raised in the current control element circuit SWt. Therefore, the following structure can be formed: the capacitance of the capacitor Cy1 and the resistance values of the charging resistor Ry1 and the discharging resistor Ry2 are suitably set; a comparator Cmy1 compares the voltage of a reference voltage signal source Vy1 having a voltage corresponding to the upper limit of the internal temperature value raised in the current control element circuit SWt with the voltage of the capacitor Cy1; as a result of comparison, only when the voltage of the capacitor Cy1 is lower than that of the reference voltage signal source Vy1, the comparator Cmy1 outputs a high-level signal; and then a gate circuit Gy02 calculates the logical product of the output of the comparator Cmy1 and the original output current modulation instruction signal Sqe.

In the above-mentioned circuit structure, when the internal temperature value raised in the current control element circuit SWt is smaller than the upper limit, the original output current modulation instruction signal Sqe is transmitted as the output current modulation instruction signal Sq. On the other hand, when the raised internal temperature value of the current control element circuit SWt is larger than the upper limit, an operation is performed such that only the output current modulation instruction signal Sq, which is in an inactive state, is generated. Therefore, the active state of the output current modulation instruction signal Sq does not last for an excessively long time, or the output current modulation instruction signal Sq does not very frequently turn to the active state, and thus the current control element circuit SWt can be protected.

Figure 3:
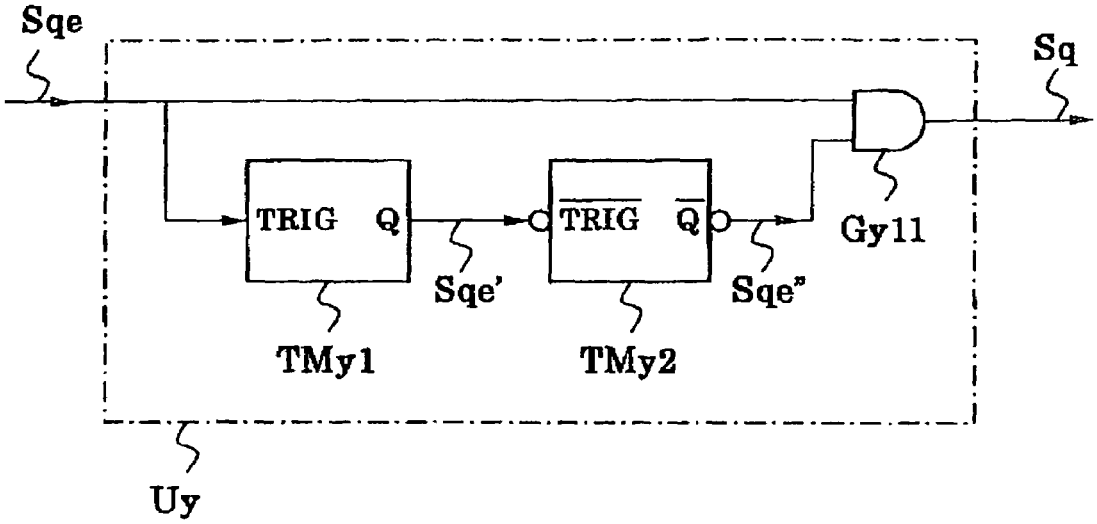
FIG. 3 is a diagram schematically illustrating another portion of the discharge lamp lighting device according to the embodiment of the invention.

FIG. 3 shows the structure of another output current modulation instruction signal correcting circuit Uy for protecting the current control element circuit SWt from the above-mentioned problem. The original output current modulation instruction signal Sqe with a positive logical value, which is supplied from the outside, is input to a timer circuit TMy1. The timer circuit TMy1 is composed of, for example, a monostable multivibrator, and generates a positive logical pulse signal Sqe' having a predetermined time width $\tau w$ which corresponds to the upper limit value of a predetermined time for which an active state lasts. The timer circuit TMy1 is triggered at the rise of the input signal to be operated. Further, the pulse signal Sqe' is input to a timer circuit TMy2 for generating a negative logical pulse signal Sqe" having a predetermined time width $\tau p$ which corresponds to the lower limit value of a predetermined time for which an inactive state lasts. The timer circuit TMy2 is triggered at the fall of the input signal to be operated. A gate circuit Gy11 calculates the logical product of the original output current modulation instruction signal Sqe and the pulse signal Sqe" to generate the output current modulation instruction signal Sq.

Figure 4:
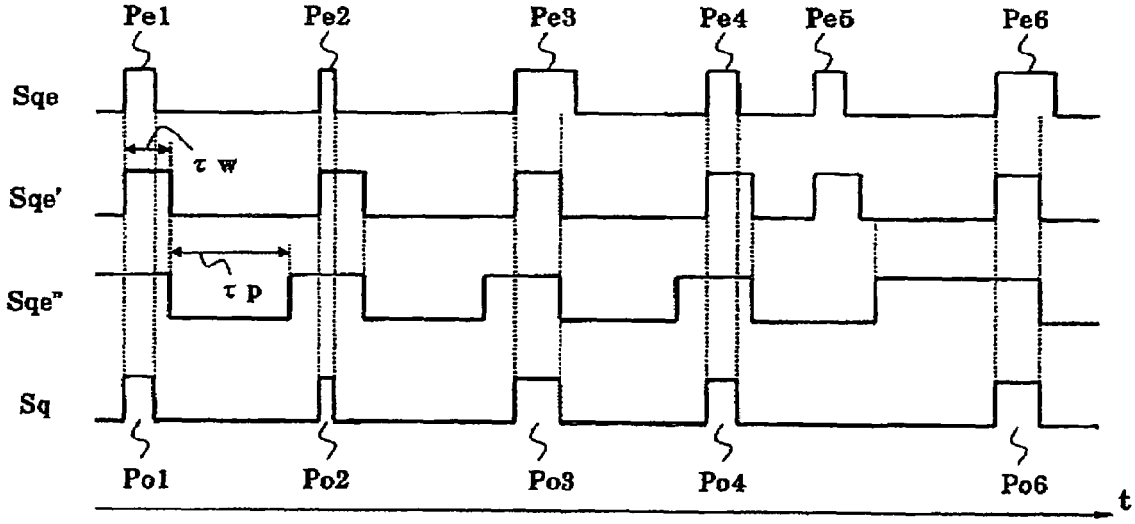
FIG. 4 is a timing chart of another portion of the discharge lamp lighting device according to the embodiment of the invention.

FIG. 4 shows an example of a timing chart related to the circuit shown in FIG. 3. Pulses Pe1, Pe2, and Pe4 of the original output current modulation instruction signal Sqe are respectively output as pulses Po1, Po2, and Po4 of the output current modulation instruction signal Sq since they are within the periods where the pulse signal Sqe" is at a high level. Pulses Pe3 and Pe6 of the original output current modulation instruction signal Sqe each have a portion beyond the period where the pulse signal Sqe" is at the high level since they exceed the upper limit value of the predetermined time for which the active state lasts. Therefore, the pulses Pe3 and Pe6 are respectively output as pulses Po3 and Po6 of the output current modulation instruction signal Sq, with the exceeded portions being removed. A pulse Pe5 of the original output current modulation instruction signal Sqe exists in a period where the pulse signal Sqe" is at a low level since it has the lower limit value of the predetermined time for which the inactive state lasts. Therefore, the entire output current modulation instruction signal Sq is removed.

As such, when portions of or all the pulses of the original output current modulation instruction signal Sqe are beyond the range of a predetermined lower limit value to a predetermined upper limit value, the portions of or all the pulses beyond the range are removed. In addition, in the periods corresponding to the removed portions, no current flows through the current control element circuit SWt, so that the current control element circuit SWt is protected.

The circuit shown in FIG. 3 has a function for, when portions of the time for which the original output current modulation instruction signal Sqe is in an active state exceed a predetermined upper limit value, removing the exceeded portions to use it as the output current modulation instruction signal Sq; and a function for removing the periods where the frequency of active states of the original output current modulation instruction signal Sqe exceeds a predetermined upper limit value and for using it as the output current modulation instruction signal Sq. If the former function is not needed, the timer circuit TMy1 may be removed, and the original output current modulation instruction signal Sqe may be directly input to the timer circuit TMy2. In addition, if the former function is not needed, the timer circuit TMy2 may be removed, and the pulse signal Sqe1 output from the timer circuit TMy1 may be directly input to the gate circuit Gy11.

In this embodiment, the timer circuit TMy2 related to the predetermined lower limit value of the time for which the inactive state lasts is controlled to perform the protection of the current control element circuit SWt from the original output current modulation instruction signal Sqe having the frequency of active states higher than the predetermined upper limit value. However, the higher the frequency of active states is, the shorter the time for which the inactive state lasts becomes. Therefore, it should be understood that the circuit shown in FIG. 3 protects the current control element circuit SWt from the original output current modulation instruction signal Sqe having the frequency of active states higher than the predetermined upper limit value. As such, if the protection can be performed in a case in which there exist the periods where the frequency of active states of the original output current modulation instruction signal Sqe exceeds the predetermined upper limit value, control can be executed on the basis of an arbitrary amount corresponding to the frequency of the original output current modulation instruction signal Sqe.

Figure 5:
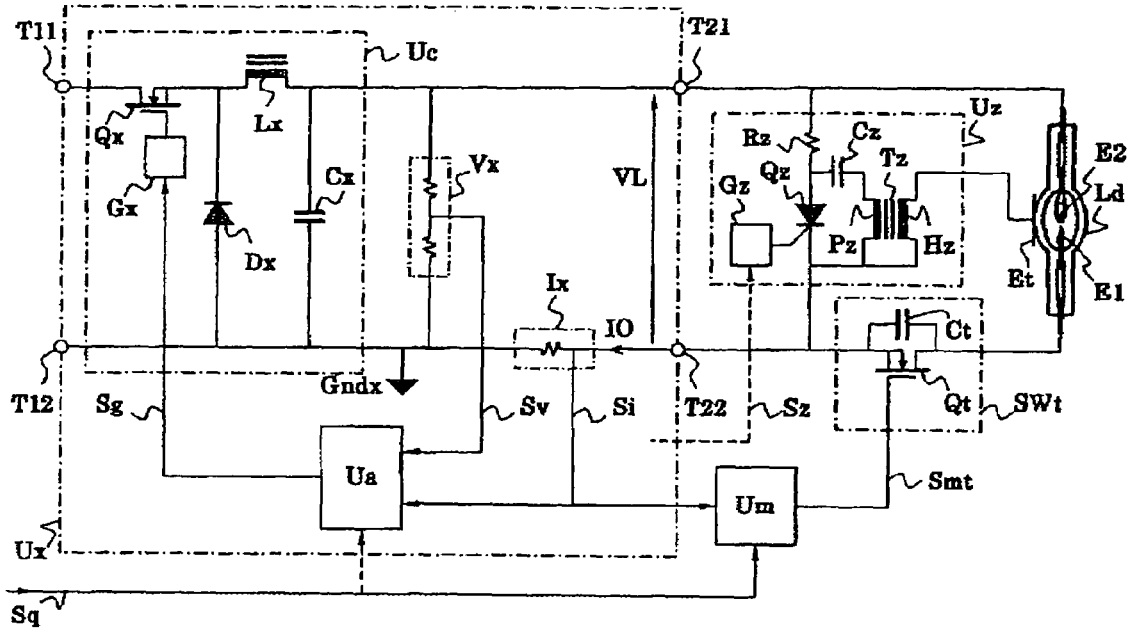
FIG. 5 is a block diagram schematically illustrating a discharge lamp lighting device according to an embodiment of the present invention.

Next, an embodiment according to the invention will be described with reference to the drawings illustrating the structure thereof in more detail. FIG. 5 is a block diagram schematically illustrating an example of the structure of a discharge lamp lighting device according to the invention which corresponds to that shown in FIG. 1, and the discharge lamp lighting device is driven by a DC driving method.

In the discharge lamp lighting device according to the invention, a power supply circuit Ux using a converter Uc of a down-chopper type as a main unit is supplied with a voltage from a DC power supply, such as a PFC, through its terminals T11 and T12 to adjust the amount of a current to be applied to the discharge lamp Ld. In the power supply circuit Ux, a switching element Qx composed of, for example, an FET breaks a current from the DC power supply or releases the breaking of the current, and the current flows through a choke coil Lx to be charged in a capacitor Cx. When a switching element Qs of the current control element circuit SWt is in an on state, a voltage is applied to the discharge lamp Ld to cause a current to flow through the discharge lamp Ld. In this structure, an over-voltage protecting capacitor Ct is connected in parallel to the switching element Qs.

Further, in the period during which the switching element Qx is in an on state, the current flowing through the switching element Qx is directly charged in the capacitor Cx and is also supplied to the discharge lamp Ld, which is a load. In addition, energy is accumulated in the choke coil Lx in the form of magnetic flux. On the other hand, in the period where the switching element Qx is an off state, the energy accumulated in the choke coil Lx in the form of magnetic flux causes a current to be charged in the capacitor Cx through a flywheel diode Dx and to be supplied to the discharge lamp Ld.

In the down-chopper-type power supply circuit Ux, the amount of a current to be supplied to the discharge lamp can be adjusted on the basis of the ratio of the period where the switching element Qx is an on state to the period where the switching element Qx is operated, that is, on the basis of a duty cycle ratio. In this embodiment, a gate driving signal Sg having a predetermined duty cycle ratio is generated by a power supply driving circuit Ug and is then supplied to a gate terminal of the switching element Qx through a gate driving circuit Gx to control the gate terminal, so that the current supply from the DC power supply is controlled.

In a starter circuit Uz, a capacitor Cz is charged by the output voltage VL from the power supply circuit Ux through a resistor Rz. For example, when the starter circuit Uz receives a trigger signal Sz generated by, for example, a microprocessor unit Mpu, which will be described later, so that a gate driving circuit Gz is activated, a switching element Qz composed of, for example, a thyristor is turned on to cause the capacitor Cz to be discharged through a primary coil Pz of a transformer Tz, so that a high-voltage pulse is generated in a secondary coil Hz. The high voltage generated in the secondary coil Hz of the starter circuit Uz is applied to a trigger electrode Et of the discharge lamp Ld to start discharge between the electrodes E1 and E2 of the discharge lamp Ld.

An output current detecting unit Ix and an output voltage detecting unit Vx detect the lamp current flowing between the electrodes E1 and E2 of the discharge lamp Ld, that is, the output current IO of the power supply circuit Ux, and a lamp voltage generated between the electrodes E1 and E2, that is, the output voltage VL of the power supply circuit Ux, respectively. The output current detecting unit Ix can be formed of a shunt resistor, and the output voltage detecting unit Vx can be formed of a resistor divider. An output current detecting signal Si from the output current detecting unit Ix and an output voltage detecting signal Sv from the output voltage detecting unit Vx are input to the power supply control circuit Ua.

Figure 6:
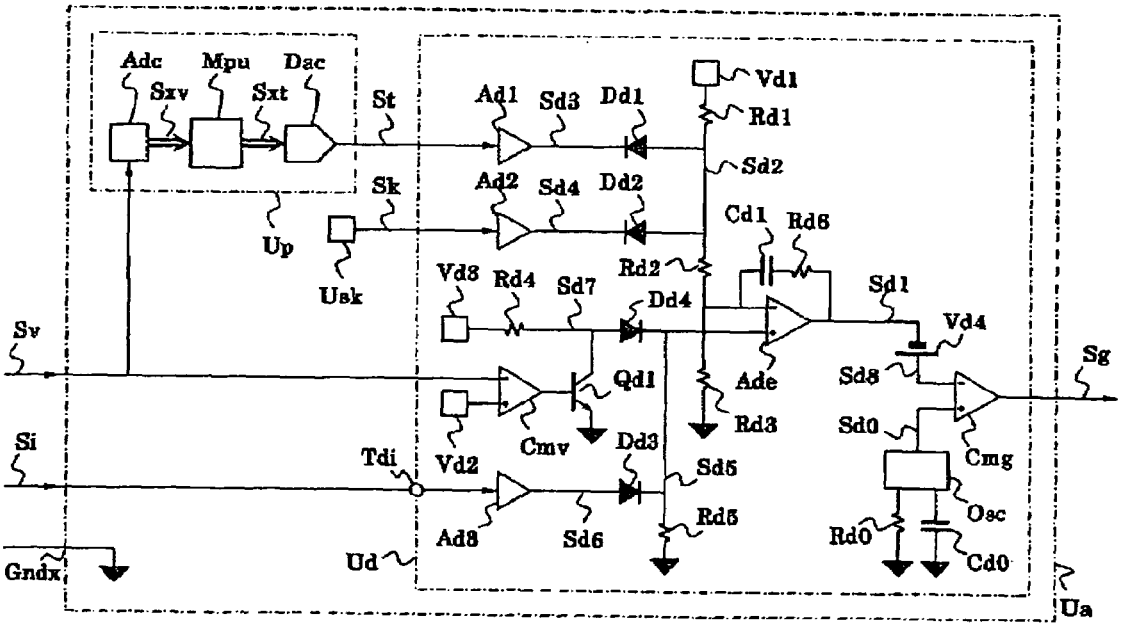
FIG. 6 is a diagram schematically illustrating a portion of the discharge lamp lighting device according to the embodiment of the invention.

FIG. 6 shows the schematic structure of the power supply control circuit Ua. The power supply control circuit Ua includes a power control circuit Up and a capability control circuit Ud as main components. The output voltage detecting signal Sv is input to an AD converter Adc of the power control circuit Up to be converted into digital lamp voltage data Sxv having a proper digit number, and the converted data is input to the microprocessor unit Mpu. In this structure, the microprocessor unit Mpu includes a CPU, a program memory, a data memory, a clock pulse generating circuit, a time counter, and an IO controller for inputting or outputting digital signals.

The microprocessor Mpu, for example, periodically updates chopper capability control target data Sxt for the capability control circuit Ud, which will be described later, on the basis of calculation referring to lamp voltage data Sxv or the determination of conditions corresponding to the state at that point of time. The chopper capability control target data Sxt is converted into an analog output current target signal St by a DA converter Dac, and the converted signal is input to the capability control circuit Ud.

Further, a lamp current upper limit signal Sk for defining an allowable upper limit value of the lamp current is generated by a lamp current upper limit signal generating circuit Usk, and is then input to the capability control circuit Ud.

In the capability control circuit Ud, the output current target signal St is supplied to one end of a pull-up resistor Rd1 through a buffer Ad1 or an amplifier, which may be provided if necessary, and a diode Dd1, and the lamp current upper limit signal Sk is supplied to the one end of the pull-up resistor Rd1 through a buffer Ad2 or an amplifier, which may be provided if necessary, and a diode Dd2. Then, a chopper driving target signal Sd2 is generated on the basis of the two signals. In addition, the other end of the pull-up resistor Rd1 is connected to a reference voltage source Vd1 having a predetermined voltage. Further, the chopper driving target signal Sd2 is one of a signal Sd3 corresponding to the output current target signal St and a signal Sd4 corresponding to the lamp current upper limit signal Sk which has a smaller magnitude.

That is, for example, the power control circuit Up divides a constant corresponding to a rated voltage by the lamp voltage data Sxv to calculate the value of the lamp current for achieving the rated voltage, and generates the output current target signal St to correspond to the value by using an arbitrary method. In this structure, even when this method is inappropriate, the capability control circuit Ud controls the chopper driving target signal Sd2 in a hardware manner such that the lamp current does not exceed the lamp current upper limit signal Sk.

Further, control by the AD converter Adc or the microprocessor unit Mpu causes a low operational speed (or when the operational speed increases, a manufacturing cost rises). Therefore, for example, when the discharge state of the lamp is suddenly changed, the delay of operation causes the generation of an inappropriate output current target signal St. Thus, the function of restricting the current in a hardware manner is advantageous in protecting the lamp or the power supply device.

Meanwhile, the output current detecting signal Si is supplied to one end of a pull-down resistor Rd5 having the other end connected to the ground Gndx, through a buffer Ad3 or an amplifier, which may be provided if necessary, and a diode Dd3, so that a control target signal Sd5 is generated.

Further, a comparator Cmv compares the output voltage detecting signal Sv with the voltage of a reference voltage source Vd2 having a voltage corresponding to the no-load open circuit voltage. As a result of comparison, when the output voltage detecting signal Sv is higher than the no-load open circuit voltage in level, a transistor Qd1 is turned off or turns to an active state, and a current flows from a proper voltage source Vd3 to the pull-down resistor Rd5 through a resistor Rd4 and a diode Dd4. As a result, the level of the control target signal Sd5 rises. On the other hand, when the output voltage detecting signal Sv is lower than the no-load open circuit voltage in level, the transistor Qd1 is turned on, and the current from the voltage source Vd3 is broken, causing the control target signal Sd5 to correspond to the output current detecting signal Si. In a circuit composed of the pull-down resistor Rd5, the diode Dd3, and the diode Dd4, one of the signals Sd6 and Sd7, having a higher level, on the anode sides of the two diodes is selected, and a voltage corresponding to the selected signal is generated at both ends of the pull-down resistor Rd5.

According to this structure, in a case in which most of the output current is broken and almost all the output current detecting signals Si are not input, when the output voltage detecting signal Sv is higher than the no-load open circuit voltage in level, the control target signal Sd5 suddenly rises. Therefore, in general, the output voltage VL is controlled to be substantially lower than the no-load open circuit voltage in a hardware manner.

The chopper driving target signal Sd2 is divided by the resistors Rd2 and Rd3 and is then input to an inverting input terminal of an operational amplifier Ade. Meanwhile, the control target signal Sd5 is input to a non-inverting input terminal of the operational amplifier Ade through the resistor Rh1. The output signal of the operational amplifier Ade, that is, a capability signal Sd1 is fed back to the inverting input terminal through an integrating capacitor Cd1 and a speed-up resistor Rd6. Therefore, the operational amplifier Ade serves as an error integrating circuit for integrating a difference between a voltage obtained by dividing the chopper driving target signal Sd2 by the resistors Rd2 and Rd3 and the voltage of the control target signal Sd5.

Figure 7:
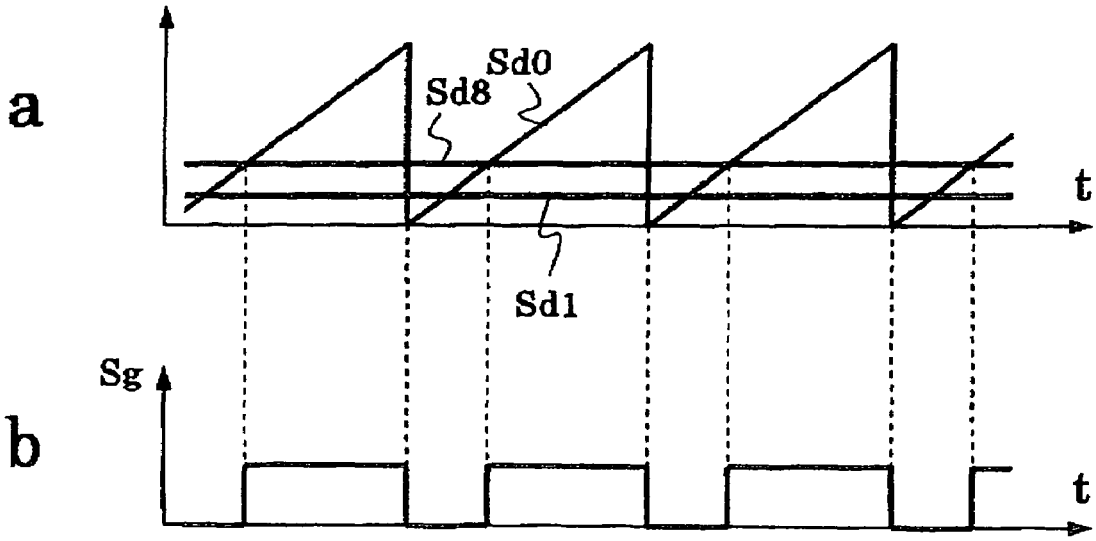
FIG. 7 is a timing chart of the portion of the discharge lamp lighting device according to the embodiment of the invention.

An oscillator Osc connected to a capacitor Cd0 and a resistor Rd0 for determining a time constant generates a sawtooth wave signal Sd0 shown in 'a' of FIG. 7, and a comparator Cmg compares the sawtooth wave signal Sd0 with the capability signal Sd1 output from the error integrating circuit. In the comparison, the sawtooth wave signal Sd0 is compared with a signal Sd8 obtained by adding an offset to the capability signal Sd1. A high-level gate driving signal Sg is generated in the period where the voltage of the sawtooth wave signal Sd0 is higher than the voltage of the signal Sd8, and is then output from the capability control circuit Ud. As described above, the signal Sd8 is obtained by adding the offset to the capability signal Sa. Therefore, even if the capability signal Sd1 is zero, the duty cycle ratio of the gate driving signal Sg has a maximum value smaller than a one-hundred percent of duty cycle ratio, that is, the duty cycle ratio is smaller than a maximum duty cycle ratio DXmax. In FIG. 7, 'a' and 'b' show the relationship among the capability signal Sd1, the signal Sd8 obtained by adding an offset to the capability signal Sd1, the sawtooth wave signal Sd0, and the gate driving signal Sg.

When the gate driving signal Sg output from the power supply driving circuit Ug is input to the gate driving circuit Gx, the output current detecting signal Si and the output voltage detecting signal Sv are fed back to the switching element Qx, so that a feedback control system is formed. In addition, in the capability control circuit Ud shown in FIG. 6, an integrated circuit of the operational amplifier Ade, the oscillator Osc, and the comparator Cmg which is obtainable from the market can be formed of, for example, TL494 manufactured by Texas Instruments Incorporated.

Figure 8:
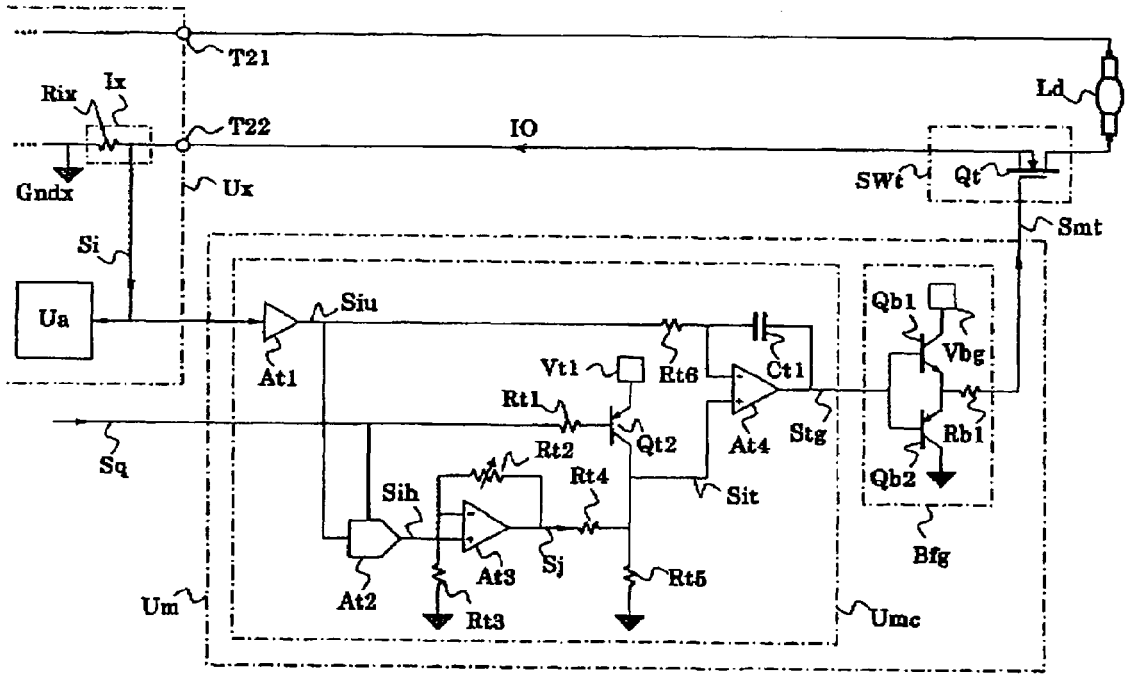
FIG. 8 is a diagram schematically illustrating a portion of the discharge lamp lighting device according to the embodiment of the invention.

FIG. 8 shows the schematic structure of a current reduction modulation control circuit Um, a current control element circuit SWt using, for example, an FET as a current control element Qt for reducing a lamp current, and the periphery thereof. The output current detecting unit Ix composed of a resistor Rix detects the output current IO of the power supply circuit Ux, that is, a current flowing through the current control element circuit SWt to generate the output current detecting signal Si. As described above, the output current detecting signal Si is input to the power supply control circuit Ua and is also input to the current reduction modulation control circuit Um as a signal Siu through a buffer At1 or an amplifier, which may be provided if necessary. The signal Siu is input to an inverting input terminal of an operational amplifier At4 through a resistor Rt6, and a modulated current target signal Sit indicating a target value with respect to the output current detecting signal Si is input to a non-inverting input terminal of the operational amplifier At4. An original current control intensity signal Stg output from the operational amplifier At4 is input, as a current restriction control signal Smt, to a gate terminal of the current control element Qt through a gate driving buffer Bfg including a buffer circuit composed of transistors Qb1 and Qb2, a power supply Vbg, and a gate resistor Rb1.

In this embodiment, the circuit structure related to the current control element Qt is generally called a source follower (an emitter follower in a case of a bipolar transistor). When the circuit structure is in an unsaturated connection state (which is called an active state) in which a source potential of the current control element Qt, that is, a voltage formed at an end of the resistor Rix connected to the current control element circuit SWt, is substantially equal to a gate potential of the current control element Qt, the current control element Qt automatically adjusts its impedance. However, since control characteristics of the FET include a non-linear characteristic, such as a gate offset, the operational amplifier At4 is operated so as to correct the non-linear control characteristic of the FET or the non-linear characteristic of the gate driving buffer Bfg by an error integrating circuit formed by arranging a capacitor Ct2 in a feedback loop. Further, preferably, the capacitor Ct2 has a small capacitance value so as to satisfy a rapid reduction in current required and a rapid restoring operation, but it may be omitted. When the capacitor Ct2 is not omitted, it is effective to provide a speed-up resistor in series to the capacitor Ct2 (similar to the integrating capacitor Cd1 shown in FIG. 6).

The signal Siu corresponding to the output current detecting signal Si is input to a track hold circuit At2 (which may be called a sample hold circuit). When the output current modulation instruction signal Sq is in an inactive state, the track hold circuit At2 outputs the input signal Siu as an output signal Sih. On the other hand, when the output current modulation instruction signal Sq is in an active state, the track hold circuit At2 holds the signal Siu and outputs it. The signal Sih corresponding to the held output current detecting signal Si is input to an non-inverting input terminal of the operational amplifier At3, and a signal obtained by dividing the output signal of the operational amplifier At3 by resistors Rt2 and Rt3 is input to a non-inverting input terminal of the operational amplifier At3. Therefore, the operational amplifier At3 serves as a non-inverting amplifier which outputs a signal proportional to the signal Sih. The modulated current target signal Sit is obtained by dividing the output signal of the operational amplifier At3 by resistors Rt4 and Rt5.

The output current modulation instruction signal Sq is input to a transistor Qt2 through a resistor Rt1. In this case, the output current modulation instruction signal Sq is in an active state at a low level. When the output current modulation instruction signal Sq is in an inactive state, the transistor Qt2 is turned on. Therefore, the modulated current target signal Sit is fixed to the voltage of a reference power source Vt1 which is connected to an emitter of the transistor Qt2 and has a proper voltage. In this structure, the voltage of the reference power source Vt1 is a voltage higher than a general maximum value of the signal Siu, that is, a voltage corresponding to the current value of the modulated current target signal Sit larger than a general maximum value of the output current IO. Meanwhile, when the output current modulation instruction signal Sq is activated, the transistor Qt2 is turned off. Therefore, the modulated current target signal Sit is proportional to the signal Sih corresponding to the output current detecting signal Si.

In a case in which the output current modulation instruction signal Sq is in an inactive state, the discharge lamp lighting device having the above-mentioned structure, shown in FIG. 5, is controlled such that the current control element Qt turns to a saturated connection state, since the modulated current target signal Sit, which is a control target value of the current flowing through the current control element Qt, has a sufficiently large value. Therefore, the current control element circuit SWt does not substantially restrict a current, causing the discharge lamp Ld to be turned on in a normal mode. As a result, for example, a rated current is maintained by feedback control.

When the output current modulation instruction signal Sq is in an active state, the modulated current target signal Sit, which is a control target value of the current flowing through the current control element Qt, is proportional to the output current detecting signal Si when the output current modulation instruction signal Sq is activated. Therefore, the current reduction modulation control circuit Um performs feedback control the current control element Qt at high speed such that a control target current flows, and the current control element circuit SWt rapidly reduces a current flowing through the discharge lamp Ld. When the output current modulation instruction signal Sq returns to an inactive state, the modulated current target signal Sit returns to a sufficiently large value. Therefore, the current control element Qt is controlled so as to rapidly return to a saturated connection state.

In this embodiment, the track hold circuit At2 is used to hold the output current detecting signal Si when the output current modulation instruction signal Sq is activated. However, when the active period of the output current modulation instruction signal Sq is very short, for example, it is also possible to use a buffer circuit in which a response speed is lowered when the output current detecting signal Si is reduced, resulting in a simple circuit structure.

Figure 9:
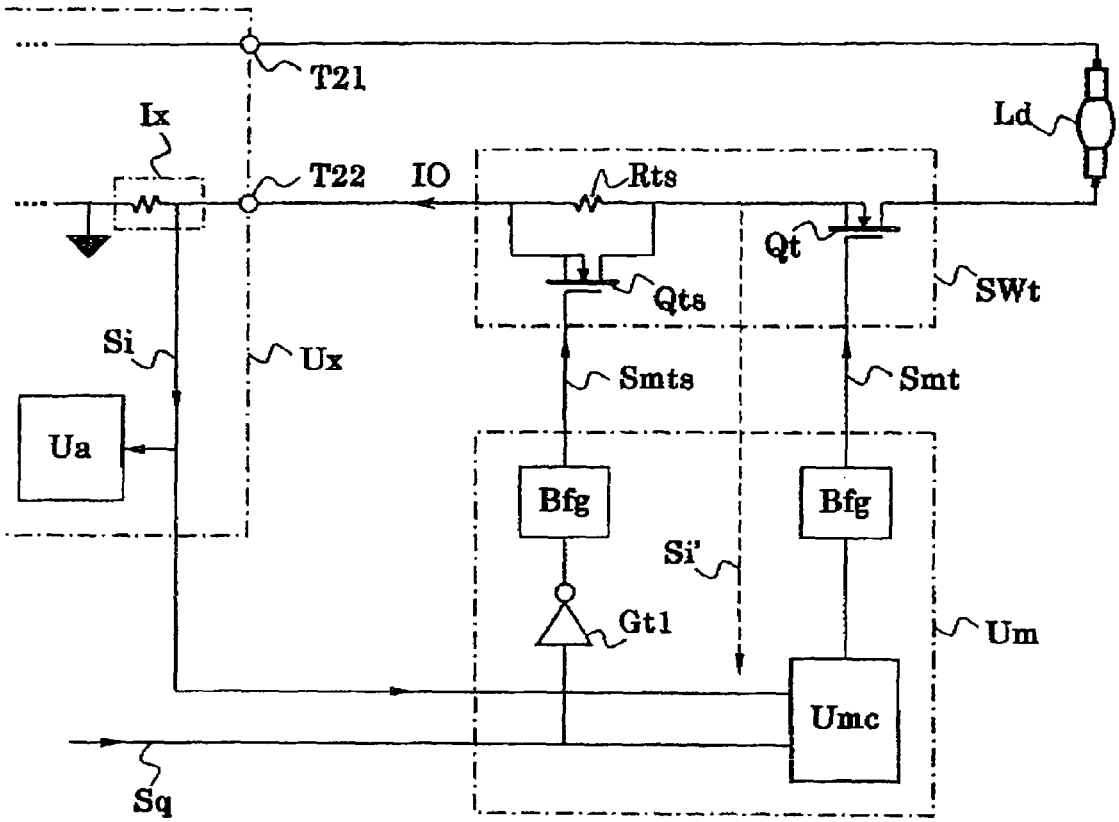
FIG. 9 is a diagram schematically illustrating a portion of the discharge lamp lighting device according to the embodiment of the invention.

FIG. 9 is a block diagram schematically illustrating the structure of a current control element circuit SWt and the current reduction modulation control circuit Um, which is a modified structure of that shown in FIG. 8. In the current control element circuit SWt, a parallel circuit of a resistor Rts and an auxiliary switching element Qts, such as an FET, is additionally provided, and the parallel circuit is connected in series to the current control element Qt.

When the output current modulation instruction signal Sq is in an active state, the current control element circuit SWt does not substantially restrict a current, causing the auxiliary switching element Qts to be in a saturated connection state. On the other hand, when the output current modulation instruction signal Sq is in an inactive state, the current control element circuit SWt restricts a current, causing the auxiliary switching element Qts to be in a disconnection state. As a result, an auxiliary switch control gate signal Smts is input to a gate terminal of the auxiliary switching element Qts. In this case, the output current modulation instruction signal Sq is in the active state at a high level, and a logic inverting gate Gt1 is additionally provided to match the control conditions of the auxiliary switching element Qts, such as connection and disconnection. The auxiliary switch control gate signal Smts is supplied via a gate driving buffer Bfg.

According to this structure, when the output current modulation instruction signal Sq is in the active state, it is possible to allot, to the resistor Rts, a portion of the loss generated from the current control element Qt for current restrictions. In addition, since the source load resistance of the current control element Qt becomes large, it is possible to more raise the source potential of the current control circuit Qt even with the same current, compared with a structure in which the resistor Rts is not provided. Thus, the structure makes it possible for the current control circuit Qt to be stably operated as a source follower.

Further, it goes without saying that the magnitude of the resistor Rts should be smaller than the minimum value of the impedance of the current control element circuit SWt in order for current restriction. Under this condition, the larger the resistance value of the resistor Rts is, the more the loss of the current control element Qt is reduced. However, when the resistance value of the resistor Rts is excessively large, the source potential of the current control element Qt excessive rises. Therefore, in this case, it is necessary to generate a high-voltage current restriction control signal Smt.

In the structure shown in FIG. 8, the power supply control circuit Ua and the current reduction modulation control circuit Um use the same output current detecting signal Si generated by the output current detecting unit Ix. In contrast, in the structure shown in FIG. 9, for example, an output current detecting signal Si' for the current reduction modulation control circuit Um can be separately generated by using a voltage drop generated at the resistor Rts, as represented by a dashed line.

Figure 10:
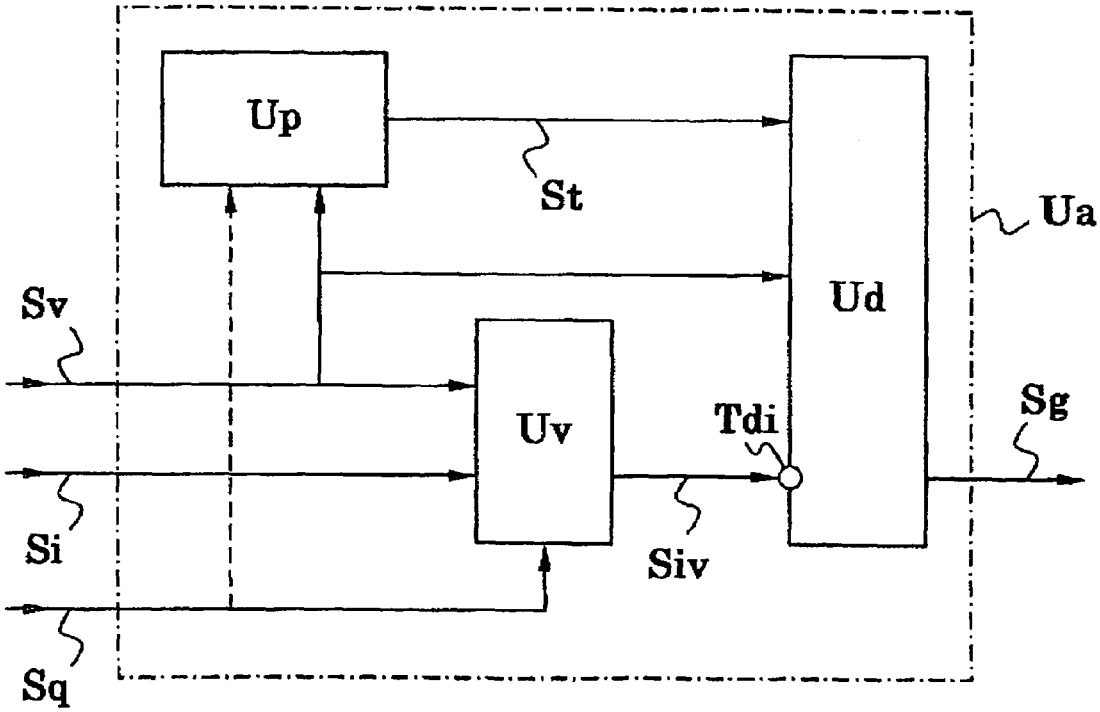
FIG. 10 is a block diagram schematically illustrating a portion of the discharge lamp lighting device according to the embodiment of the invention.

FIG. 10 is a block diagram illustrating an improved power supply control circuit Ua capable of generating the gate driving signal Sg and of controlling the converter Uc such that a difference between the output voltage detecting signal Sv when the output current modulation instruction signal Sq is activated and the output voltage detecting signal Sv is reduced to the minimum. The structure shown in FIG. 10 differs from that shown in FIG. 6 in that a control target switching circuit Uv is additionally provided in the power supply control circuit Ua and, instead of the output current detecting signal Si being input through a terminal Tdi, a modulation control target signal Siv output from the control target switching circuit Uv is input to the capability control circuit Ua shown in FIG. 6.

Figure 11:
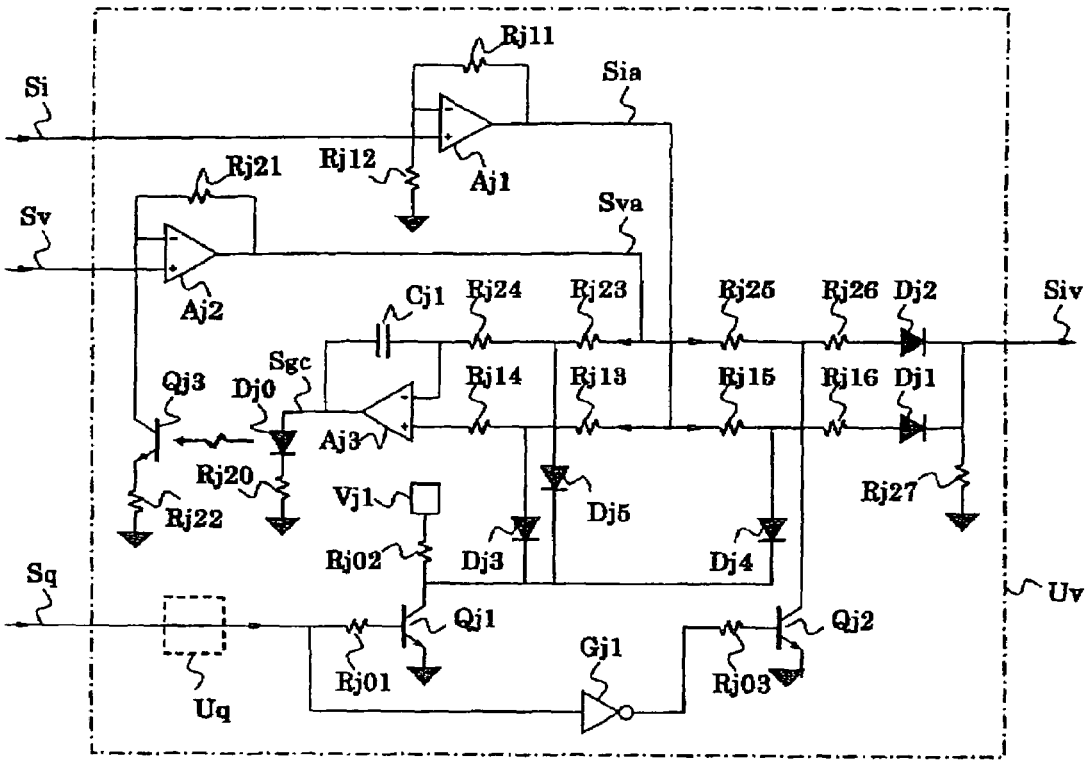
FIG. 11 is a diagram schematically illustrating a portion of the discharge lamp lighting device according to the embodiment of the invention.

FIG. 11 shows the schematic structure of the control target switching circuit Uv. In the structure shown in FIG. 11, the output current detecting signal Si is input to a non-inverting input terminal of an operational amplifier Aj1, and a signal obtained by dividing a signal Sia output from the operational amplifier Aj1 by resistors Rj11 and Rj12 is input to an inverting input terminal thereof. Therefore, a circuit composed of the operational amplifier Aj1 serves as a non-inverting amplifier.

The output voltage detecting signal Sv is input to a non-inverting input terminal of an operational amplifier Aj2, and a signal obtained by dividing a signal Sva output from the operational amplifier Aj2 by resistors Rj11 and Rj12 and a transistor Qj3 of a photocoupler is input to an inverting input terminal thereof. Therefore, a circuit composed of the operational amplifier Aj2 serves as a non-inverting amplifier. In this structure, the higher the voltage of a signal Sgc causing a current to flow through an LED Dj0 for controlling the impedance of the transistor Qj3 and a resistor Rj20 is, the lower the impedance of the transistor Qj3 becomes. Therefore, a non-inverting amplifier circuit composed of the operational amplifier Aj2 serves as a gain variable amplifier capable of setting the gain on the basis of the signal Sgc.

The signal Sia is input to a non-inverting input terminal of an operational amplifier Aj3 through resistors Rj13 and Rj14, and the signal Sva is input to an inverting input terminal of the operational amplifier Aj3 through resistors Rj23 and Rj24. In addition, the signal Sgc output from the operational amplifier Aj3 is fed back through a capacitor Cj1. Therefore, a circuit composed of the operational amplifier Aj3 serves as an error integrating circuit which integrates an error between the signal Sia and the signal Sva. A circuit structure composed of the operational amplifiers Aj1, Aj2, and Aj3 performs feedback control on the signal Sgc such that the signal Sva is equal to the signal Sia, and thus the gain of the gain variable amplifier composed of the operational amplifier Aj2 is automatically adjusted.

However, in a case in which a transistor whose on or off state is controlled by the output current modulation instruction signal Sq supplied through a resistor Rj01 is in the on state, when signals input to the error integrating circuit composed of the operational amplifier Aj3 flow to the ground through a diode Dj2 provided at the middle point of the resistors Rj13 and Rj14 and a diode Dj5 provided at the middle point of the resistors Rj23 and Rj24, the error integrating circuit stops its integrating operation, and the signal Sgc immediately before the stop operation is held. As a result, the gain of the gain variable amplifier composed of the operational amplifier Aj2 is held.

Further, it is assumed that the output current modulation instruction signal Sq is in an active state at a high level. In this case, when the output current modulation instruction signal Sq is in an inactive state, the signal Sva obtained by amplifying the output voltage detecting signal Sv is always maintained to be equal to the signal Sia even when the output voltage detecting signal Sv varies. On the other hand, when the output current modulation instruction signal Sq is in the active state, the signal Sva is maintained when the output current modulation instruction signal Sq is in the active state. Then, when the output voltage detecting signal Sv varies, the signal Sva is changed in proportional to the variation.

Meanwhile, the signal Sia flows to a resistor Rj27 through resistors Rj15 and Rj16 and a diode Dj1, and the signal Sva flows to the resistor Rj27 through resistors Rj25 and Rj26 and a diode Dj2. A diode Dj4 is connected to the transistor Qj1 and the middle point of the resistors Rj15 and Rj16, and the transistor Qj1 is connected to the ground when the output current modulation instruction signal Sq is in the inactive state. In addition, a transistor Qj2 connected to the middle point of the resistors Rj25 and Rj26 is connected to the ground through a logic inverting gate Gj1 and a resistor Rj03 when the output current modulation instruction signal Sq is in the inactive state. Therefore, when the output current modulation instruction signal Sq is in the inactive state, the signal Sia is selected as the modulation control target signal Siv, which is the voltage formed at both ends of the resistor Rj27. On the other hand, when the output current modulation instruction signal Sq is in an active state, the signal Sva is selected as the modulation control target signal Siv.

In this case, the term 'selection' includes selecting the signal and multiplying the signal by a division ratio determined by the resistance values of the resistors Rj15, Rj16, Rj25, and Rj26. The division ratio means the product of gains of the non-inverting amplifier composed of Aj1, and the total gain of the control target switching circuit Uv can be arbitrarily set. However, for the purpose of simplicity of description, it is assumed that the total gain of the control target switching circuit Uv is set to 1. In addition, it is also assumed that the resistors Rj15 and the resistor Rj25 have the same resistance value, and the resistors Rj16 and the resistor Rj26 have the same resistance value.

According to this structure, when the output current modulation instruction signal Sq is in an inactive state, the modulation control target signal Siv output from the control target switching circuit Uv is always equal to the output current detecting signal Si. On the other hand, when the output current modulation instruction signal Sq is in an active state, the value of the output current detecting signal Si is maintained, and the modulation control target signal Siv is related to the output voltage detecting signal Sv using the value as an initial value. That is, when the output current modulation instruction signal Sq is in the inactive state, the output current detecting signal Si is selected as the modulation control target signal Siv. On the other hand, when the output current modulation instruction signal Sq is in the active state, the output voltage detecting signal Sv is selected as the modulation control target signal Siv. When the output voltage detecting signal Sv is selected, it is multiplied by the gain such that the modulation control target signal Siv is not discontinuous, and then the signal is output. Therefore, when the output voltage detecting signal Sv does not vary in a period where the output current modulation instruction signal Sq is in the active state, the modulation control target signal Siv continues to maintain the value immediately before the output current modulation instruction signal Sq is activated.

The capability control circuit Ud of the power supply control circuit Ua does not recognize which of the output current detecting signal Si and the output voltage detecting signal Sv corresponds to the modulation control target signal Siv, but generates the gate driving signal Sg causing the modulation control target signal Siv to be always equal to the output current target signal. Therefore, when the output current modulation instruction signal Sq is activated, the output voltage detecting signal Sv functions to maintain the level before the output current modulation instruction signal Sq is activated.

In the discharge lamp lighting device according to the invention, when the output current modulation instruction signal Sq is in an inactive state, the power supply control circuit Ua shown in FIG. 10 determines a lamp current target value for realizing target power according to the magnitude of the output current modulation instruction signal Sq, and performs feedback control to adjust the capability of the converter Uc, on the basis of the gate driving signal Sq, in order to the target value. In addition, when the output current modulation instruction signal Sq is in an active state, the power supply control circuit Ua generates the gate driving signal Sg and controls the converter Uc such that a difference between the output voltage detecting signal Sv when the output current modulation instruction signal Sq is activated and the output voltage detecting signal Sv is reduced to the minimum. As a result, when the output current modulation instruction signal Sq returns to the inactive state, it is possible to solve the problem of the overshoot of the output current IO and the problem of a long time being required for restoring the reduced current to the original state.

Figure 12:
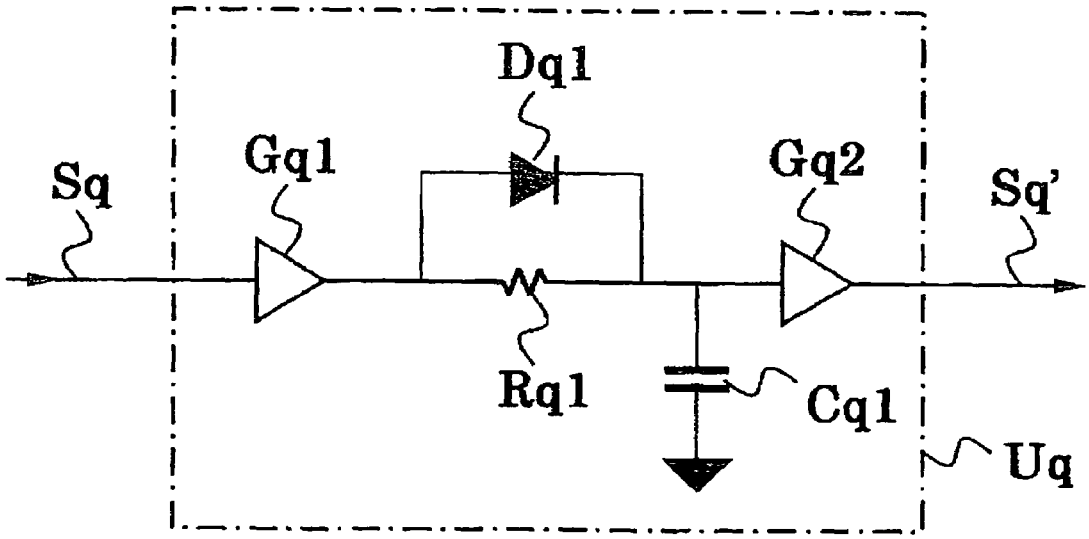
FIG. 12 is a diagram schematically illustrating a portion of the discharge lamp lighting device according to the embodiment of the invention.

When the output current modulation instruction signal Sq returns to the inactive state, the current control element Qt returns to a saturated connection state, and an operation of releasing the reduction of the output current IO starts. Therefore, when delay occurs during a period where the modulation control target signal Siv, serving as the output current detecting signal Si, returns to the state before the output current modulation instruction signal Sq, is activated, falling in level or overshoot may occur in the modulation control target signal Siv. In order to solve this problem, it is preferable to additionally provide a signal delay circuit Uq for the output current modulation instruction signal Sq, shown in FIG. 12, to an input portion of the control target switching circuit Uv shown in FIG. 11 to which the output current modulation instruction signal Sq is input, as represented by a dashed line in FIG. 11, if necessary.

In the signal delay circuit Uq, when the output current modulation instruction signal Sq turns to a high level, which is an active state, a current is charged into a capacitor Cq1 through a buffer Gq1 and a diode Dq1, and is immediately transmitted through a Schmitt buffer Gq2. On the other hand, when the output current modulation instruction signal Sq turns to an inactive state, the current is discharged from the capacitor Cq1 through a resistor Rq1. Therefore, a delay in transmission occurs depending on these CR time constants.

The power control circuit Up determines the output current target signal St on the basis of the output voltage detecting signal Sv. In addition, as described above, when the output current modulation instruction signal Sq is in an inactive state, the power supply control circuit Ua shown in FIG. 10 generates the gate driving signal Sg and controls the converter Uc such that a difference between the output voltage detecting signal Sv when the output current modulation instruction signal Sq is activated and the output voltage detecting signal Sv is reduced to the minimum. Therefore, if the output voltage VL of the power supply circuit Ux, that is, the output voltage detecting signal Sv is varied due to, for example, a variation in measurement in the power control circuit Up, the operation of the power control circuit Up becomes complicated. Here, in general, the output voltage detecting signal Sv does not vary. Thus, the following structure is preferable: as represented by a dashed line in FIG. 10, the output current modulation instruction signal Sq is also input to the power control circuit Up; and, when the output current modulation instruction signal Sq is in an active state, the microprocessor unit Mpu of the power control circuit Up does not update the output voltage detecting signal Sv.

Further, in the control target switching circuit Uv shown in FIG. 11, the following structure is not used: the output current detecting signal Si or the output voltage detecting signal Sv is selected on the basis of the output current modulation instruction signal Sq, and is then simply output as the modulation control target signal Siv. Of course, this structure can achieve the same function as described above. However, in this case, when the output current modulation instruction signal Sq is activated, the output current target signal St should be immediately updated to a value suitable for the output voltage detecting signal Sv. The value suitable for the output voltage detecting signal Sv is simply obtained by holding the value of the output voltage detecting signal Sv when the output current modulation instruction signal Sq is activated, and switching between the output current target signal St and the original output current target signal occurs in order to generate the output voltage detecting signal Sv. Thus, the structure of the embodiment is used.

Figure 13:
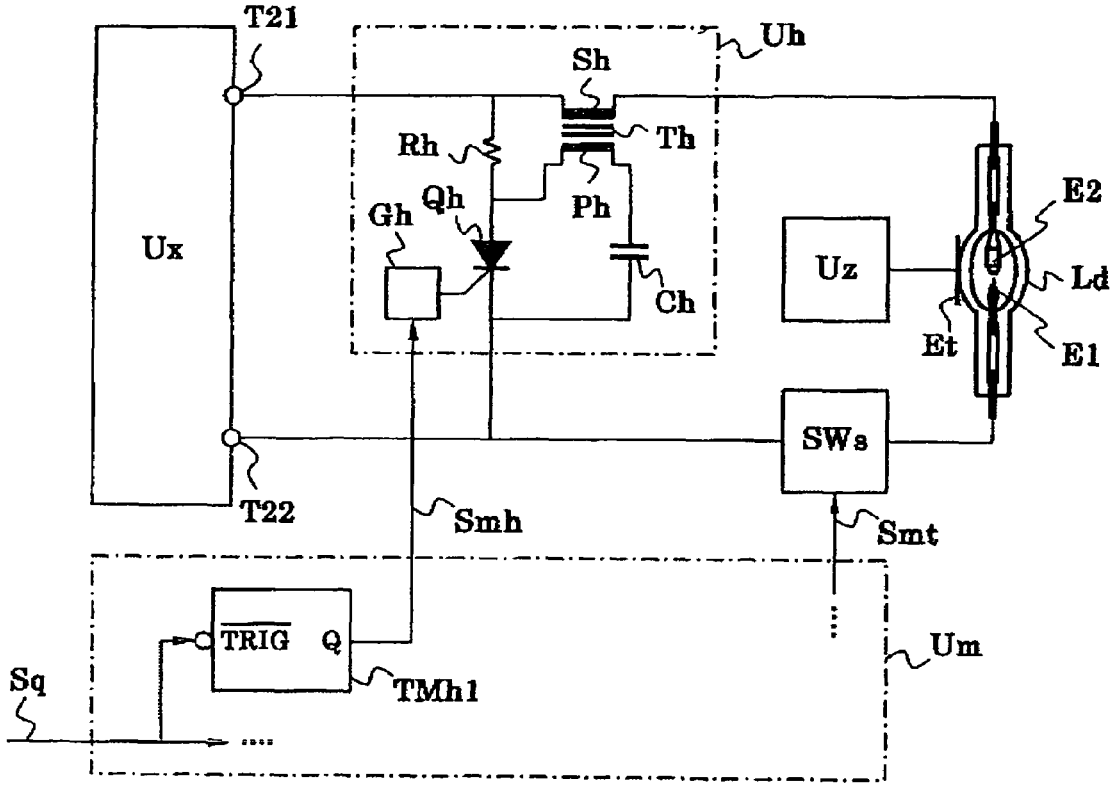
FIG. 13 is a diagram schematically illustrating a discharge lamp lighting device according to an embodiment of the present invention.

FIG. 13 shows an example of the schematic structure of a temporary booster unit Uh. It is assumed that the output current modulation instruction signal Sq is in an active state at a high level. In this case, when the output current modulation instruction signal Sq returns to the active state to an inactive state, a timer circuit TMh1 composed of, for example, a monostable multivibrator generates a high-level pulse having a predetermined time width, for example, the temporary booster unit trigger signal Smh. Meanwhile, a current is charged into a capacitor Ch through a resistor Rh by the output voltage VL of the power supply circuit Ux. At the time when the current control element circuit SWt releases the breaking of a current, when a gate driving circuit Gh receives the temporary booster unit trigger signal Smh and is then activated, a switching element Qh composed of, for example, a thyristor is turned on to cause the capacitor Ch to be discharged through a primary coil Ph of a transformer Th, so that pulses are generated in a secondary coil Sh. The pulses overlap the output voltage VL of the power supply circuit Ux and are then applied to the discharge lamp Ld.

Figure 14:
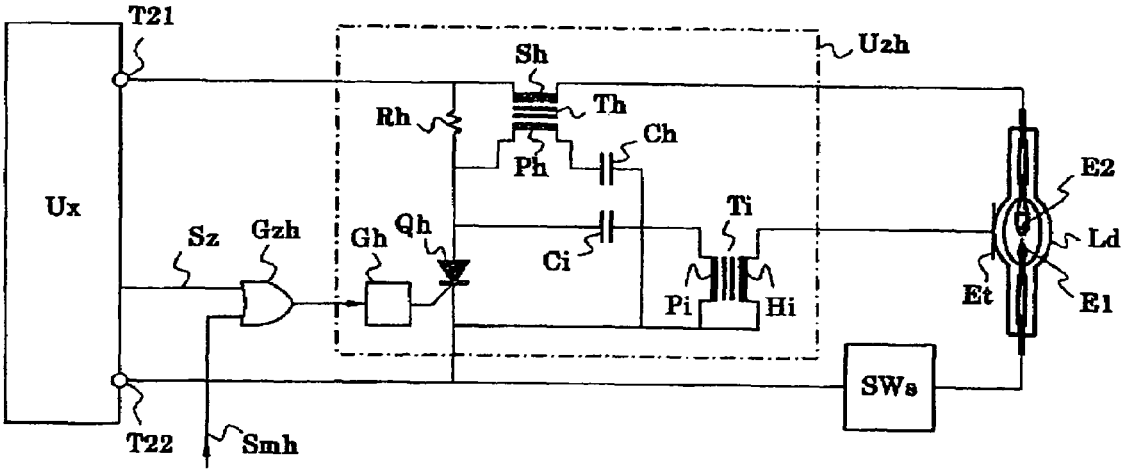
FIG. 14 is a diagram schematically illustrating a discharge lamp lighting device according to an embodiment of the present invention.

As in a circuit portion Uzh shown in FIG. 14, the temporary booster unit Uh shown in FIG. 13 can be combined with the starter circuit Uz shown in FIG. 5, so a common switching element Qh and a common gate driving circuit Gh can be used. An OR gate Gzh calculates the logical sum of the trigger signal Sz for operating the starter and the temporary booster unit trigger signal Smh, which causes the gate driving circuit Gh to be operated even when the trigger signal Sz or the temporary booster unit trigger signal Smh is activated.

At the time of the lighting of a lamp, the output voltage VL of the power supply circuit Ux is a no-load discharge voltage. At that time, as described above, generally, the output voltage VL is relatively high about 300 V. Meanwhile, when the current control element circuit SWt releases the current reducing operation, the output voltage VL of the power supply circuit Ux is a normal lamp lighting voltage. At that time, as described above, generally, the output voltage VL is relatively low about 100 V. Therefore, it is necessary to set constants of circuit elements for operating the starter, such as the capacitor Cz and the transformer Tz, on the basis of the output voltage VL of the no-load discharge voltage, and to set constants of circuit elements for operating the temporary booster unit, such as the capacitor Ch and the transformer Th, on the basis of the output voltage VL of the normal lamp lighting voltage.

However, in this structure, at the time of start, the pulse voltage of the temporary booster unit is applied to the discharge lamp Ld, which makes it easy to start the lighting of the lamp. Therefore, this structure does not raise any problem. In addition, when the current control element circuit SWt releases the current reducing operation, a voltage is generated at the transformer Tz. However, in this case, as described above, the output voltage VL of the power supply circuit Ux is lower than a voltage required for operating the starter, and the voltage does not affect the above-mentioned operation. Thus, this structure does not also raise any problem.

In order to prevent a voltage from being generated at the transformer Th when the current control element circuit SWt releases the current reducing operation, after the start of the discharge lamp Ld is completed, both ends of the primary coil Ph of the transformer Th may be connected to each other by a switching element, or they may be disconnected from each other by the switching element such that no current flows through the primary coil Ph.

Of course, as described above, the value of the proportional constant K depends on circuit constants, such as a resistance value. For example, in the circuit shown in FIG. 8, a variable resistor can be used as the resistor Rt2, and it is possible to arbitrarily set the value of the proportional constant K by adjusting the resistance value of the resistor Rt2. However, this method is unsuitable for a structure in which the setting of the discharge lamp lighting device is dynamically changed during operation or a structure in which the optimum conditions of an optical device provided with the discharge lamp lighting device are automatically set according to usage conditions.

In order to change the setting of the proportional constant K on the basis of a signal input from the outside, the current reduction modulation control circuit Um may further include a detected current signal converting circuit Ai for converting the output current detecting signal Si or the signal Sih corresponding to the output current detecting signal Si. The detected current signal converting circuit Ai includes a plurality switches Z0, Z1, . . . , Zn whose on or off states are controlled corresponding to a true or fault value of each of natural-number-bit binary conversion gain signals M0, M1, . . . , Mn, and the gain is varied by a combination of true and fault values of each of the conversion gain signals M0, M1, . . . , Mn.

Figure 15:
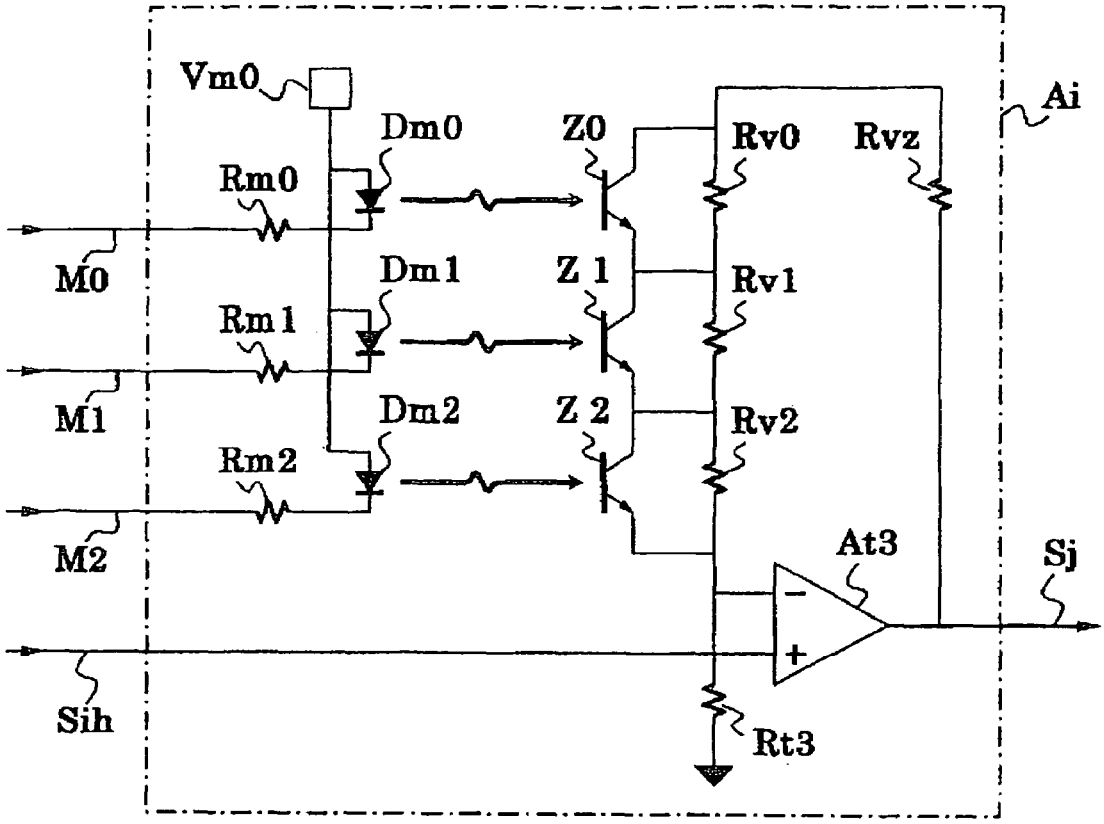
FIG. 15 is a diagram schematically illustrating a portion of the discharge lamp lighting device according to the embodiment of the invention.

FIG. 15 shows an example of a circuit structure in which the value of the proportional constant K is added to the operational amplifier At3 shown in FIG. 8, on the basis of the signal input from the outside of the discharge lamp lighting device, in order to change the setting thereof. More specifically, resistors Rv0, Rv1, and Rv2 connected to each other in series are used instead of the resistor Rt2, and switches Z0, Z1, and Z2 composed of photocoupler transistors are connected in parallel to the resistors Rv0, Rv1, and Rv2, respectively. In this way, the operational amplifier At3 is used for a gain-variable non-inverting amplifier circuit as the detected current signal converting circuit Ai for converting the signal Sih.

The on or off state of each of the switches Z0, Z1, and Z2 composed of photocoupler transistors can be set by controlling the flow of a current to LEDs Dm0, Dm1, and Dm2 of photocouplers having anodes connected to a power source Vm0 through resistors Rm0, Rm1, and Rm2, on the basis of the true or fault value of each of the 3-bit binary conversion gain signals M0, M1, and M2. Therefore, it is possible to control the connection of the resistors Rv0, Rv1, and Rv2 on the basis of the true or fault value of each of the conversion gain signals M0, M1, and M2.

For example, when the resistance value of the resistor Rv1 is set to be two times the resistance value of the resistor Rv0 and the resistance value of the resistor Rv2 is set to be two times the resistance value of the resistor Rv1, it is possible to set eight types of combined resistance values proportional to the magnitudes of the binary conversion gain signals M0, M1, and M2, on the basis of the theory of a DA converter. However, in the circuit structure shown in FIG. 15, a resistor Rvz is additionally provided to set the minimum of the combined resistance value.

The conversion gain signals M0, M1, and M2 may be set by an external device, such as an optical device provided with a discharge lamp lighting device. Alternatively, the microprocessor unit Mpu may receive information from an external device through an interface, such as EIA232, and then may set the conversion gain signals M0, M1, and M2 on the basis of the received information.

In the discharge lamp lighting device having the above-mentioned structure, since the gain of the amplifier circuit composed of the operational amplifier At3 is changed on the basis of the conversion gain signals M0, M1, and M2, it is possible to change the setting of the proportional constant K on the basis of signals input from the outside. In addition, in this embodiment, the 3-bit binary conversion gain signals are used, but the invention is not limited thereto. Any binary conversion gain signals having arbitrary bits can be used.

Figure 16:
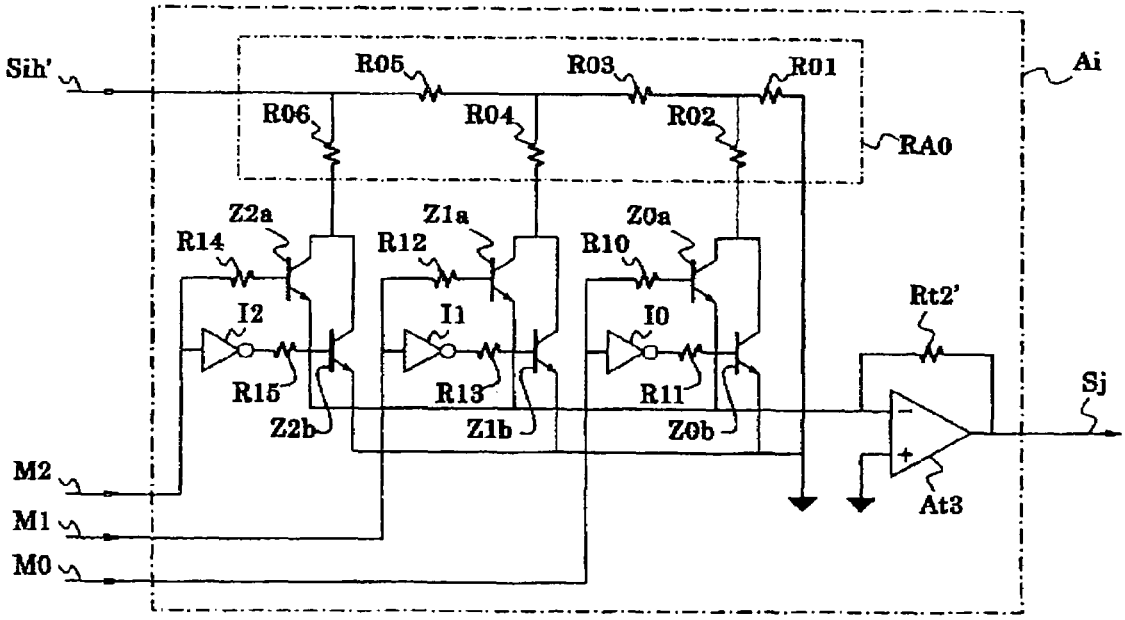
FIG. 16 is a diagram schematically illustrating a portion of the discharge lamp lighting device according to the embodiment of the invention.

FIG. 16 shows another example of the circuit structure in which the proportional constant K is added to the operational amplifier At3 shown in FIG. 8, on the basis of the signal input from the outside of the discharge lamp lighting device, in order to change the setting thereof.

In the detected current signal converting circuit Ai shown in FIG. 16, switching elements Z0*a*, Z1*a*, and Z2*a* are provided such that their on and off states are controlled corresponding to the true and fault values of each bit of the conversion gain signals M0, M1, and M2, and logic inverting gates I0, I1, and I2 are connected to bases of switching elements Z0*b*, Z1*b*, and Z2*b*. Therefore, when one of the switching elements Z0*a* and Z0*b* is in an on state, the other switching element is in an off state. When one of the switching elements Z1*a* and Z1*b* is in an on state, the other switching element is in an off state. When one of the switching elements Z2*a* and Z2*b* is in an on state, the other switching element is in an off state.

In FIG. 16, the resistance values of resistors R03 and R05 are equal to each other, and the resistance values of resistors R01, R02, R04, and R06 are equal to each other, on the basis of the theory of a DA converter. Therefore, a ladder resistance network RA0 whose resistance value is two times the resistor R03 or R05 is used, which is preferable from the relationship between the magnitudes of the binary conversion gain signals M0, M1, and M2 and conversion characteristics. Further, it is also possible to use a DA converting IC.

Since the detected current signal converting circuit Ai shown in FIG. 16 is composed of an inverting amplifier, it can be applied to the circuit structure shown in FIG. 8. In this case, it is necessary to make the polarity of an output current detecting signal Si', which is an input signal of the detected current signal converting circuit Ai, reverse to that of the output current detecting signal Si by setting the ground for signals to the lamp rather than to the output current detecting unit Ix. Alternatively, the input signal or output signal may be inverted by using another inverting amplifier.

Figure 17:
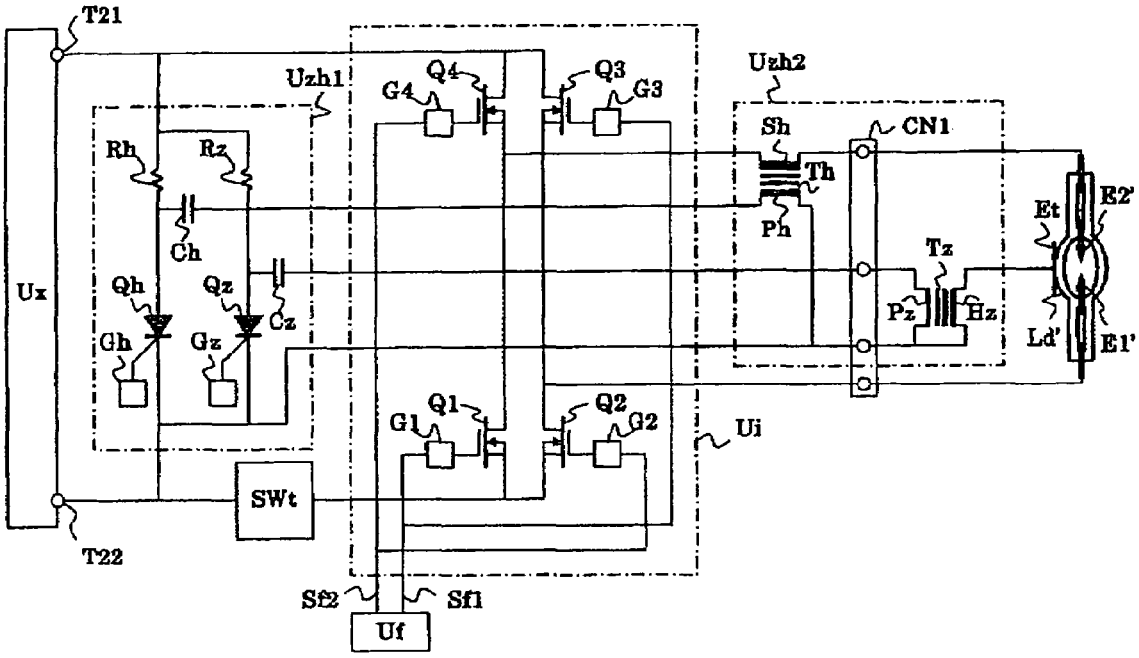
FIG. 17 is a diagram schematically illustrating a discharge lamp lighting device according to an embodiment of the present invention.

Although the discharge lamp lighting device using the DC driving method has been described above, the invention can be applied regardless of the type of lamp. For example, the invention can be applied to a discharge lamp lighting device using an AC driving method. FIG. 17 shows an example of the schematic structure of a discharge lamp lighting device using the AC driving method according to the invention. The discharge lamp lighting device includes an inverter Ui of a full-bridge type that is provided in a subsequent stage of the power supply circuit Ux.

Switching elements Q1, Q2, Q3, and Q4 composed of, for example, FETs are respectively driven by gate driving circuits G1, G2, G3, and G4 corresponding thereto, and the gate driving circuits G1, G2, G3, and G4 are controlled by inverter control signals Sf1 and Sf2 output from an inverter control circuit Uf such that the switching elements Q1 and Q3 and the switching elements Q2 and Q4, which are diagonal elements of a full-bridge inverter, are turned on (saturated) at the same time. Dead time τd is set at portions where the active states of the inverter control signals Sf1 and Sf2 are switched to make them inactive, in order to prevent the switching elements Q1 and Q4 and the switching elements Q2 and Q3, connected in series to each other, from being turned on at the same time so that a current does not flow therethrough at the same time. For example, a circuit shown in FIG. 18, which will be described later, can be used as the inverter control circuit Uf for generating these inverter control signals Sf1 and Sf2.

Figure 18:
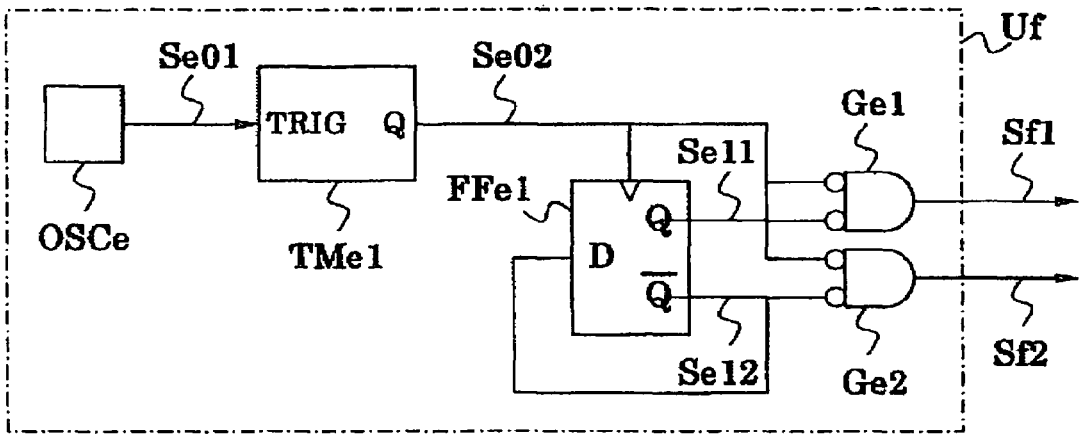
FIG. 18 is a diagram schematically illustrating a portion of the discharge lamp lighting device according to the embodiment of the invention.

In FIG. 18, a signal Se01 output from a polarity inversion instruction circuit OSCe for giving the polarity inversion timing of the inverter is input to a timer circuit TMe1 composed of, for example, a monostable multivibrator, and then the timer circuit TMe1 generates a signal Se02 corresponding to the dead time τd. The signal Se02 is input to a clock signal input terminal of a delay flip-flop FFe1 having an input terminal connected to an inverting output terminal thereof. An output signal and an inverted output signal of the delay flip-flop FFe1 are respectively input to input terminals of NOR gates Ge1 and Ge2, and the signal Se02 is input to the other input terminals of the NOR gates Ge1 and Ge2. In this way, the inverter control signals Sf1 and Sf2, each having the dead time τd at the portions where their active states are switched, are generated, and both ends of the dead time τd are in inactive states. It is possible to use the inverter control signals Sf1 and Sf2 to control gates of switching elements of the general inverter Ui shown in FIG. 17 and an inverters Ui' shown in FIG. 19, which will be described later.

In the structure shown in FIG. 17, it is possible to apply an alternating discharge voltage to main discharge electrodes E1' and E2' of a discharge lamp Ld' to light the discharge lamp Ld'. The current control element circuit SWt for reducing a current flowing through the discharge lamp Ld' may be provided between the power supply circuit Ux and the inverter Ui.

Further, when the starter circuit Uz shown in FIG. 5 and the temporary booster unit Uh shown in FIG. 13 are mounted, the following structure may also be used: a circuit portion is divided into a primary circuit portion Uzh1 and a secondary circuit portion Uzh2; the primary circuit portion Uzh1 is mounted between the power supply circuit Ux and the current control element circuit SWt; and the secondary circuit portion Uzh2 is mounted between the inverter Ui and the discharge lamp Ld'.

The reason why the circuit portion is divided into two circuit portions is that, since the secondary circuit portion of the temporary booster unit generates a high voltage, the switching elements Q1, Q2, Q3, and Q4 of the inverter Ui may be damaged when the temporary booster unit is provided in the front stage of the inverter Ui. In addition, the reason is that, since the primary circuit portion Uzh1 needs to receive DC power, it is preferable to provide the primary circuit portion Uzh1 at a position which is not affected by the state of the current control element circuit SWt or by the phase of the inverter Ui. Further, for the starter circuit, a connecting terminal CN1 for connecting a circuit board and a lamp panel of the discharge lamp lighting device is preferably provided at the position shown in FIG. 17.

The discharge lamp lighting device shown in FIG. 17 is formed by adding the inverter Ui to the structure shown in FIG. 1. In the discharge lamp lighting device, switching elements constituting the inverter Ui are also used as switching elements Qt of the current control element circuit SWt for reducing a current flowing through the discharge lamp Ld, which makes it possible to reduce the manufacturing costs of a discharge lamp lighting device.

In order for the above-mentioned operation, preferably, the discharge lamp lighting device includes a power supply circuit Ux for supplying power to the discharge lamp Ld; an inverter Ui which is provided in a subsequent stage of the power supply circuit Ux and includes switching elements for repeatedly inverting the polarity of a voltage applied to the discharge lamp Ld, thereby performing a repeatedly inverting operation; and a current reduction modulation control circuit Um having an output current modulation instruction signal Sq applied thereto. The power supply circuit Ux includes an output current detecting unit Ix for detecting an output current IO of the power supply circuit Ux to generate an output current detecting signal Si. When the output current modulation instruction signal Sq is in an active state, the current reduction modulation control circuit Um controls at least one of the switching elements of the inverter Ui, which are in the saturated connection states, to turn to an unsaturated state, in order to perform the repeatedly inverting operation, so that the output current detecting Si is substantially equal to a value obtained by multiplying, by a proportional constant K, the output current detecting signal Si when the output current modulation instruction signal Sq is activated.

Figure 19:
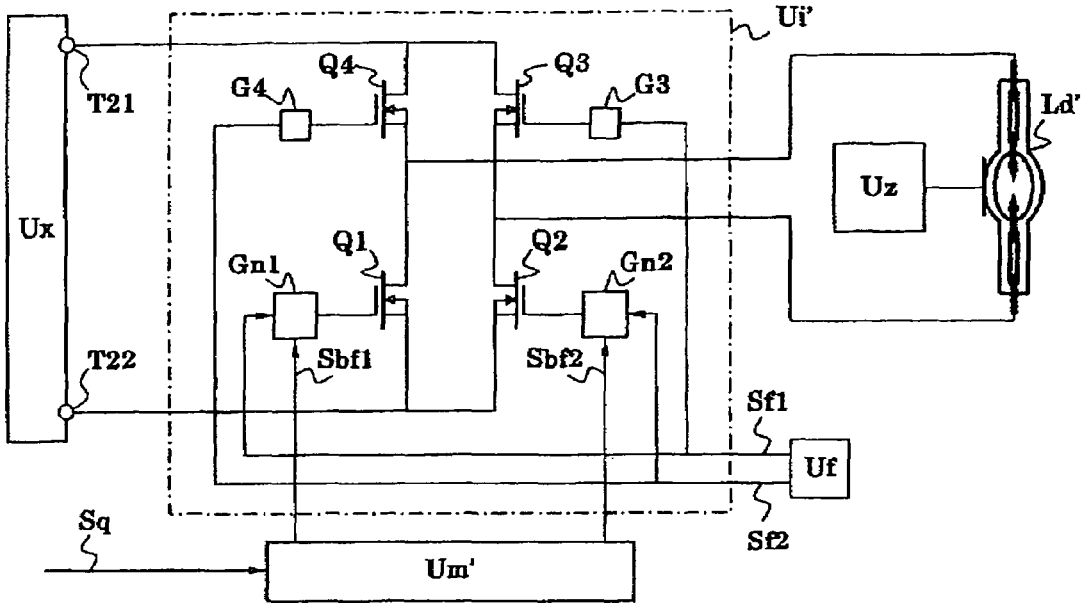
FIG. 19 is a diagram schematically illustrating a discharge lamp lighting device according to an embodiment of the present invention.

FIG. 19 shows an example of the schematic structure of a discharge lamp lighting device using the AC driving method according to the invention. The discharge lamp lighting device includes an inverter Ui' of a full-bridge manner which is provided in the next stage of the power supply circuit Ux. In the discharge lamp lighting device, switching elements Q1 and Q2 of the inverter Ui' are also used as current control elements of the current control element circuit SWt for reducing a current flowing through the discharge lamp Ld.

Similar to the inverter shown in FIG. 17, gate driving circuits G3 and G4 are provided in the switching elements Q3 and Q4 of the inverter Ui', respectively, to control (saturated) connection or disconnection of the switching elements Q3 and Q4, on the basis of inverter control signals Sf1 and Sf2 output from an inverter control circuit Uf. Further, current control gate driving circuits Gn1 and Gn2 are respectively provided in the switching elements Q1 and Q2 to control (saturated) connection or disconnection of the switching elements Q1 and Q2, on the basis of the inverter control signals Sf1 and Sf2 and to control the flow of a current such that the switching elements Q1 and Q2 are in unsaturated connection states, on the basis of current control intensity signals Sbf1 and Sbf2 output from a current reduction modulation control circuit Um'.

Figure 20:
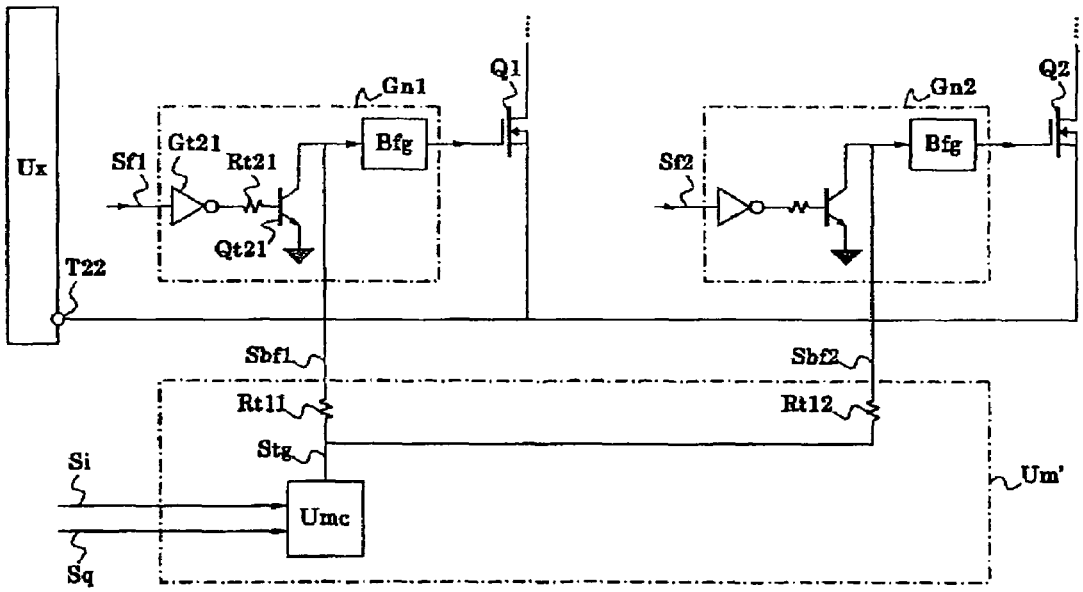
FIG. 20 is a diagram schematically illustrating a portion of the discharge lamp lighting device according to the embodiment of the invention.

FIG. 20 shows an example of the schematic structure of a portion of a discharge lamp lighting device including the current reduction modulation control circuit Um' and the current control gate driving circuits Gn1 and Gn2. An original current control intensity signal Stg is generated in the same functional block as shown in FIG. 8 by the same manner as described above, on the basis of an output current detecting signal Si and an output current modulation instruction signal Sq.

The inverter control signal Sf1 for a general inverter operation is input to the current control gate driving circuit Gn1. In this structure, for the polarity of the inverter control signal Sf1, it is assumed that, when the inverter control signal Sf1 is at a high level, the switching element Q1 is turned on for a general inverter operation; and when the inverter control signal Sf1 is at a low level, the switching element Q1 is turned off for the general inverter operation. In this case, preferably, when the inverter control signal Sf1 is at the high level, the switching element Q1 is controlled depending on the original current control intensity signal Stg. On the other hand, preferably, when the inverter control signal Sf1 is at the low level, the switching element Q1 is turned off, regardless of the original current control intensity signal Stg.

Therefore, a logic inverting gate Gt21 is provided for matching the polarity of the inverter control signal Sf1, as described above. When the inverter control signal Sf1 is at a low level, it flows to a transistor Qt21 through a resistor Rt21, causing the transistor Qt21 to be turned on. Then, the current control intensity signal Sbf1 connected to the original current control intensity signal Stg output from the functional block Umc through a resistor Rt11 flows to the ground, which causes the voltage of the current control intensity signal Sbf1 to be forcibly reduced to zero. On the other hand, when the inverter control signal Sf1 is at a high level, the transistor Qt21 is turned off. Then, the voltage of the current control intensity signal Sbf1 is changed to a voltage corresponding to the original current control intensity signal Stg.

As such, the current control intensity signal Sbf1 has a voltage for causing the switching element Q1 to be turned off or a voltage corresponding to the original current control intensity signal Stg, according to the inverter control signal Sf1. The current control intensity signal Sbf1 is input to a gate driving buffer Bfg in the same functional block as shown in FIG. 8 to drive the gate of the switching element Q1.

A circuit for the switching element Q2 may be formed completely similar to the circuit for the switching element Q1 shown in FIG. 20. Further, since the output current detecting signal Si is irrelevant to the on or off states of the switching elements Q1 and Q2, only one functional block Umc is provided.

In the discharge lamp lighting device having the above-mentioned structure, when the output current modulation instruction signal Sq is in an inactive state, the inverter Ui' shown in FIG. 19, serving as a general full-bridge inverter, applies an alternating discharge voltage to the discharge lamp Ld', on the basis of the inverter control signals Sf1 and Sf2 output from the inverter control circuit Uf, to turn it on. On the other hand, when the output current modulation instruction signal Sq is in an active state, the current reduction modulation control circuit Um' rapidly performs feedback control on one of the switching elements Q1 and Q2 which is in an off state at that time, so that a current flowing through the discharge lamp Ld' is rapidly reduced to a predetermined value that is proportional to the value of the output current detecting signal Si when the output current modulation instruction signal Sq is activated.

The above-mentioned circuit structures are just illustrative examples for describing the operation, function, and effect of the discharge lamp lighting device according to the invention, but the invention is not limited thereto. Therefore, the invention premises that a detailed circuit structure or operation, for example, the polarities of signals, can be changed at the time when the device is actually designed, on the basis of the selection, addition, or omission of circuit elements, the convenience of acquisition of elements, and economic reasons.

In particular, the invention premises that a structure for protecting switching elements composed of, for example FETs from, for example, an overvoltage, an overcurrent, and overheating, or a structure for reducing radiation noises or conduction noises generated by the operation of circuit elements of a power supply circuit or for preventing the generated noise from being transmitted to the outside, for example, a snubber circuit, a varistor, a clamping diode, a current control circuit (which includes a pulse-by-pulse method), a common-mode or normal-mode noise filter choke coil, or a noise filter capacitor, can be additionally provided to each unit of the circuit structures described in the embodiments, if necessary. The structure of the discharge lamp lighting device according to the invention is not limited to the above-mentioned circuit structures, and the invention is not also limited to the above-mentioned waveforms or timing charts.

Further, for example, in the above-described embodiments, the lamp voltage detecting signal corresponding to the lamp voltage is converted into a digital signal, and the output current target signal is set on the basis of the converted signal. However, a lamp current detecting signal corresponding to a lamp current may be converted into a digital signal, and an output current target signal may be corrected and set such that the obtained current value is equal to a target current value, which makes it possible to correct a variation in the parameters of each circuit element, resulting in a high-precision and high-performance device. Alternatively, for example, the microprocessor unit may be removed to simplify a control circuit, which makes it possible to simplify the structure of a light source device. In addition, the structure of the light source device can be changed in various manners. In this case, the effects according to the invention can also be obtained.

What is claimed is:

1. A discharge lamp lighting device that lights a discharge lamp having a pair of main discharge electrodes facing each other, comprising:

a power supply circuit which supplies power to the discharge lamp;

a current control element circuit which reduces a current flowing through the discharge lamp; and a current reduction modulation control circuit to which an output current modulation instruction signal is input, wherein the power supply circuit includes an output current detecting unit which detects an output current of the power supply circuit to generate an output current detecting signal, and wherein when the output current modulation instruction signal Sq is in an inactive state, the current reduction modulation control circuit controls the current control element circuit not to substantially restrict the current, and when the output current modulation instruction signal is in an active state, the current reduction modulation control circuit controls the current control element circuit such that the output current detecting signal is substantially equal to a value obtained by multiplying, by a proportional constant, the output current detecting signal obtained when the output current modulation instruction signal is activated.

2. The discharge lamp lighting device according to claim 1, wherein the power supply circuit further includes an output voltage detecting unit which detects an output voltage of the power supply circuit to generate an output voltage detecting signal and a power supply control circuit which controls the capability of the power supply circuit, and wherein when the output current modulation instruction signal is in the inactive state, the power supply control circuit performs control such that a difference between the output current detecting signal and an output current target signal indicating a control target value with respect to the output current detecting signal is reduced, and when the output current modulation instruction signal is in the active state, the power supply control circuit performs control such that a difference between the output voltage detecting signal obtained when the output current modulation instruction signal is activated and the output voltage detecting signal is reduced.

3. The discharge lamp lighting device according to claim 1, further comprising a temporary booster unit which temporarily raises a voltage to be applied to the discharge lamp, wherein, when the output current modulation instruction signal returns to the inactive state, the current reduction modulation control circuit operates the temporary booster unit.

4. The discharge lamp lighting device according to claim 1, wherein the proportional constant K is changed on the basis of a signal input from the outside.

5. The discharge lamp lighting device according to claim 1, wherein the current reduction modulation control circuit controls the current control element circuit such that no current flows through the current control element circuit when the output current modulation instruction signal is in the active state for a predetermined period or more.

6. The discharge lamp lighting device according to claim 1, wherein the current reduction modulation control circuit controls the current control element circuit such that no current flows through the current control element circuit when the frequency of active states of the output current modulation instruction signal exceeds a predetermined upper limit.

7. The discharge lamp lighting device according to claim 1, further comprising an inverter which is provided in a subsequent stage of the power supply circuit and includes switching elements for repeatedly inverting the polarity of the voltage to be applied to the discharge lamp, wherein at least one of the switching elements of the inverter is used as part of the current control element circuit.

* * * * *